US008689935B2

(12) United States Patent
Wilson et al.

(10) Patent No.: US 8,689,935 B2
(45) Date of Patent: Apr. 8, 2014

(54) ABATING LOW-FREQUENCY NOISE USING ENCAPSULATED GAS BUBBLES

(75) Inventors: Preston S. Wilson, Austin, TX (US); Kevin M. Lee, Austin, TX (US); Mark S. Wochner, Austin, TX (US)

(73) Assignee: Board of Regents of the University of Texas System, Austin, TX (US)

( * ) Notice: Subject to any disclaimer, the term of this patent is extended or adjusted under 35 U.S.C. 154(b) by 35 days.

(21) Appl. No.: 13/453,720

(22) Filed: Apr. 23, 2012

(65) Prior Publication Data

US 2013/0001010 A1 Jan. 3, 2013

Related U.S. Application Data

(60) Provisional application No. 61/478,172, filed on Apr. 22, 2011.

(51) Int. Cl.
*F01N 13/12* (2010.01)

(52) U.S. Cl.
USPC ..... 181/235; 181/210; 181/115; 181/296; 367/24

(58) Field of Classification Search
USPC ..... 181/235, 210, 115, 296; 367/24
See application file for complete search history.

(56) References Cited

U.S. PATENT DOCUMENTS

| | | | | |
|---|---|---|---|---|
| 3,022,632 | A | 2/1962 | Parks | |
| 5,658,656 | A | 8/1997 | Whitney et al. | |
| 6,567,341 | B2 * | 5/2003 | Dreyer et al. | 367/1 |
| 6,571,906 | B2 * | 6/2003 | Jones et al. | 181/117 |
| 6,743,367 | B2 * | 6/2004 | Dreyer | 210/747.6 |
| 7,126,875 | B2 * | 10/2006 | Baskerville et al. | 367/24 |
| 2007/0140518 | A1 * | 6/2007 | Larsen | 381/354 |
| 2011/0031062 | A1 * | 2/2011 | Elmer | 181/175 |

* cited by examiner

*Primary Examiner* — Forrest M Phillips
(74) *Attorney, Agent, or Firm* — Meyertons, Hood, Kivlin, Kowert & Goetzel, P.C.; Eric B. Meyertons

(57) ABSTRACT

Air bubbles may be used to reduce radiated underwater noise. Two modalities of sound attenuation by air bubbles were shown to provide a reduction in radiated sound: bubble acoustic resonance damping and acoustic impedance mismatching. The bubbles used for acoustic resonance damping were manifested using gas-filled containers coupled to a support, and the acoustic impedance mismatching bubbles were created using a cloud of freely-rising bubbles, which were both used to surround an underwater sound source.

14 Claims, 41 Drawing Sheets

ABATING LOW-FREQUENCY NOISE USING ENCAPSULATED GAS BUBBLES

PRIORITY CLAIM

This application claims the benefit of U.S. Provisional Application No. 61/478,172 filed on Apr. 22, 2011.

BACKGROUND OF THE INVENTION

1. Field of the Invention

The invention generally relates to a device capable of abating noise. More specifically, the device relates to reducing low frequency noise in an aquatic environment.

2. Description of the Relevant Art

Noise abatement techniques are often employed to satisfy environmental regulations, which are in place to protect marine life and habitat. For example, underwater acoustic noise from drilling ships in the Arctic is known to adversely affect the migratory patterns of marine mammals. Much of this noise occurs at low frequencies between 10 Hz and 200 Hz. Governmental environmental regulations related to underwater noise limit the oil exploration and drilling season in this region to a small fraction of the year. The current strategy for dealing with these regulations is a passive one in which biologists and other experts are employed by the oil companies to survey large areas in the vicinity of operations for these animals. Once their presence is detected, communications are sent back to the ship and operations are halted, making this strategy quite expensive and further reducing the amount of time spent exploring and drilling. Thus, there is an industry-wide need for an active noise abatement solution.

Underwater sound abatement technologies include either the use of freely rising bubbles or the deployment of air-filled, hard spherical shells. Systems that use freely rising gas bubbles generally require the continuous supply of compressed air, which in turn requires operation of an air compressor, thus consuming energy and also radiating its own noise. If the compressor is powered by a combustion engine, air pollution is created. Furthermore, air supply lines are typically run from the compressor to the location of deployment, thus increasing capital and deployment costs. Meanwhile, the use of air-filled, hard spherical shells has proven to be acoustically unsatisfactory for frequencies below 1000 Hz. Also, due to their physical dimensions, air-filled hard spherical shell systems are expensive to transport and deploy in the field.

SUMMARY OF THE INVENTION

As described herein and in the accompanying materials, the inventors hereof have discovered that encapsulated bubbles may be used to abate, mitigate, or attenuate low-frequency, anthropogenic underwater noise in various applications and configurations. For example, in some embodiments, an encapsulating material, shell, container, or capsule may hold a first fluid or medium (e.g., air, gas, etc). The container may be sufficiently thin and flexible to achieve desired levels of sound attenuation or abatement (e.g., 10 dB, 20 dB, or more, depending upon the application). For example, in some cases the shell may include a flexible membrane constructed with latex, vinyl, rubber or other suitable materials, and may have a wall thickness of approximately between about 0.5 mm to about 5 mm. The gas-filled container may have a non-spherical or a substantially non-spherical wall (e.g., a toroidal shape or spherical cap geometry), and may have a physical characteristic designed to confer a selected resonance frequency to the shell upon immersion into a second fluid or medium (e.g., water, freshwater, saltwater, mixtures of water and hydrocarbons, etc.) at a predetermined depth. In some cases, the physical characteristic that at least in part determines the resonance frequency of the gas-filled container may include an effective spherical radius, an effective spherical diameter, or an effective spherical volume of the container or membrane.

A plurality of gas-filled shells may be coupled, attached, or connected to a support. For example, a support may include a network of lines, cables, pipes, beams, etc. forming a mesh, net, framework or the like. In some embodiments, the support may be provided in the form of a spool. A cable may be a metal, rope or polymeric cable. Further, the apparatus may be configured or adapted to attenuate sound emitted by a sound source. To that end, the apparatus may be positioned near the sound source in a curtain configuration or a cloud configuration. For example, a network of gas-filled containers may be deployed in the form of dome, cube, etc. encompassing the sound source. Additionally or alternatively, a network of gas-filled containers may be interposed between a sound source and a region, underwater, that is in need of protection from sounds emanating from an underwater sound source to act as a wall, barrier, or the like. In some embodiments, two or more such networks may be used together (e.g., in parallel with each other or side-by-side).

Containers coupled to an array or network may be separated from one another by a selected distance. In some applications, a sound field generated by the sound source has one or more components with a frequency between approximately 10 Hz and 1000 Hz, and the resonance frequencies of one or more gas-filled containers in the array are selected to approximately match the frequencies of the one or more components. In some embodiments, the level of abatement is proportional to the number density of gas-filled containers or the void fraction occupied by gas.

In a non-limiting scenario, an array of gas-filed containers may be deployed such that the effective spherical radius, an effective spherical diameter, or an effective spherical volume of the containers follow a distribution (e.g., a Gaussian distribution) designed to attenuate a particular frequency range. In another non-limiting scenario where a sound source produces signals components (e.g., harmonics) at two or more distinct frequencies, an array of gas-filled containers may be designed such that a first set of containers may have a first resonance frequency that approximately matches a first one of the distinct frequencies, a second set of containers may have a second resonance frequency that approximately matches a second one of the distinct frequencies, and so on. The number of gas-filled containers in the various sets of gas-filed containers may be proportional to the desired attenuation for each corresponding frequency. In a more general case, any number of signal components and corresponding sets of gas-filled containers may be used. Furthermore, the effective spherical volume of the gas-filled containers in each distinct set may have its own distribution. As such, the various sets of differently designed gas-filled containers may independently control the attenuation in a particular frequency band, and therefore "filter" the spectrum emitted by the sound source as desired. In addition, when the sound source has directional components, differently designed gas-filled containers may be appropriately positioned around the source so that their resonance frequencies match corresponding directional components. In some embodiments, two or more networks of gas-filled containers may each be designed to address a particular frequency band, and thus facilitate an appropriate distribution of different gas-filed containers around the source (e.g., a directional source).

In various embodiments, the use of thin-walled, flexible encapsulation, may allow an enclosed bubble of any size to be formed. Further, non-spherical shapes (e.g., toroidal shape, similar to tire inner tubes) may allow for easy attachment of the bubbles to noisy structures or machinery, and may include a gas valve or the like suitable for underwater operation.

In some embodiments, the level of noise abatement may be proportional to the number density of gas-filled containers and hence the cost of the network, array, mesh, or net; therefore, the level of abatement may be dictated by the financial constraints of a particular project, and not by the techniques disclosed herein. In some embodiments, a noise abatement system may utilize inexpensive, readily available, mass-produced, off-the-shelf components, to offer considerable flexibility in deployment on or around underwater noise sources. Once deployed, at least some of these systems may require little or no power to operate.

Illustrative applications for the systems and methods described herein include, but are not limited to, the abatement of underwater noise radiated by oil drilling ships, drilling rigs, underwater construction, pile driving, shipboard machinery and engine noise, marine wind turbine installations, underwater seismic surveying operations, or any other source of anthropogenic underwater noise. In other applications, various embodiments described herein may also be used to abate underwater noise radiated by military vessels, reduce detectability by sonar systems, etc.

BRIEF DESCRIPTION OF THE DRAWINGS

Advantages of the present invention will become apparent to those skilled in the art with the benefit of the following detailed description of embodiments and upon reference to the accompanying drawings in which.

Figure 1:
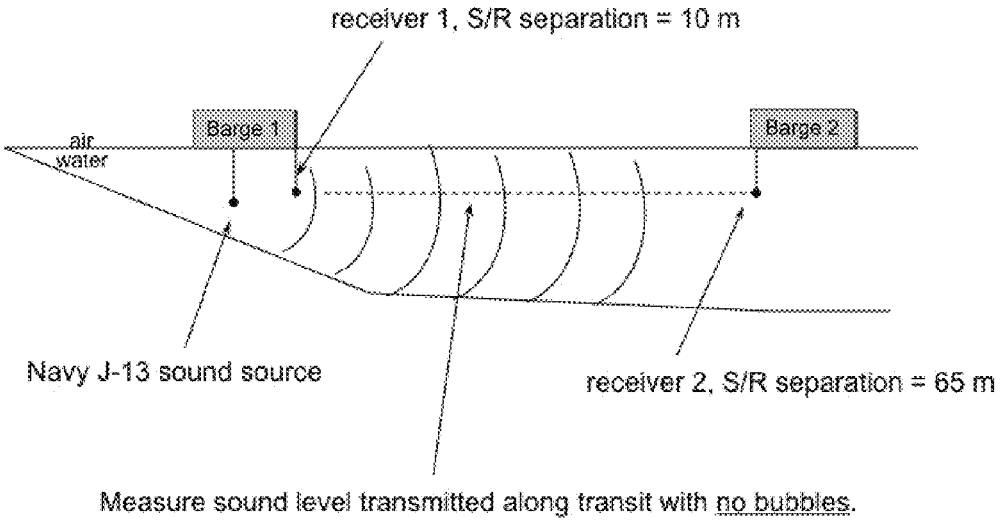
FIG. 1 depicts a schematic view of a testing experiment in the absence of a sound reducing device.

While the invention may be susceptible to various modifications and alternative forms, specific embodiments thereof are shown by way of example in the drawings and will herein be described in detail. The drawings may not be to scale. It should be understood, however, that the drawings and detailed description thereto are not intended to limit the invention to the particular form disclosed, but to the contrary, the intention is to cover all modifications, equivalents, and alternatives falling within the spirit and scope of the present invention as defined by the appended claims.

DETAILED DESCRIPTION OF THE PREFERRED EMBODIMENTS

It is to be understood the present invention is not limited to particular devices or methods, which may, of course, vary. It is also to be understood that the terminology used herein is for the purpose of describing particular embodiments only, and is not intended to be limiting. As used in this specification and the appended claims, the singular forms "a", "an", and "the" include singular and plural referents unless the content clearly dictates otherwise. Furthermore, the word "may" is used throughout this application in a permissive sense (i.e., having the potential to, being able to), not in a mandatory sense (i.e., must). The term "include," and derivations thereof, mean "including, but not limited to." The term "coupled" means directly or indirectly connected.

In some embodiments, the term "approximately" may refer to a value that is within 1% of another value. For example, a shell, container, or capsule having a resonance frequency of 101 Hz may be deemed to approximately match the frequency of a sound component at 100 Hz. In other embodiments, the term "approximately" may refer to a value that is within 10% of another value, in which case a resonance frequency of 110 Hz would be deemed to approximately match the frequency of a sound component at 100 Hz. In yet other embodiments, term "approximately" may refer to a value that is within 25% of another value. For example, a resonance frequency of 125 Hz may be deemed to approximately match the frequency of a sound component at 100 Hz. Also, in some embodiments the term "substantially non-spherical" may be used to refer to features that are largely non-spherical. For example, a sufficiently flexible spherical feature, when immersed in a particular medium, may be subject to compression and/or other forces that may alter its largely spherical shape, even if only slightly (e.g., a sphere may be transformed into an ovoid, or the like). This is in contrast with a "substantially non-spherical" feature such as, for example, a toroid, which is naturally non-spherical.

The strategy described herein involves the use of air bubbles to reduce radiated acoustic noise. The acoustic effects of air bubbles in water are well-known and have been studied extensively for at least 100 years with many documented results. One key aspect of bubble acoustics is that an air bubble in water behaves as a simple harmonic oscillator. A layer of water that surrounds the bubble acts as an effective mass, the compressibility of the air inside the bubble behaves as an effective spring, and the bubble will resonate when excited. An acoustic wave that encounters a collection of bubbles experiences significant attenuation due to energy lost through a variety of mechanisms, and the sound speed in the bubbly water is significantly altered compared to bubble-free water. Both of these effects can be potentially used to abate noise radiated from a drilling ship.

Previous examples of air bubbles in underwater acoustic screening have primarily exploited the acoustic impedance contrast between bubble-free and bubbly water. This mechanism has been shown to result in the reduction in the amplitude of transmitted sound with some success. A "bubble curtain" has been used to abate noise from an underwater pile driving operation, however, its effectiveness was limited likely due to sound transmission through the seafloor. Bubbles have also been employed on naval ships to abate both machinery and propeller noise at higher frequencies with a system called Prairie-Masker, although the technology is not available for commercial applications.

The devices described herein exploit both the bubble resonance and acoustic impedance mismatch mechanisms to reduce the radiated sound from an underwater device. In embodiments, the decibel level of sound emanating from an underwater device may be reduced by:

- an array of confined gas-filled containers with individual bubble resonance frequencies below 1000 Hz;
- a diffuser hose-generated cloud of sub-resonant bubbles; or
- a combination of the two systems.

Testing of the device can be accomplished by analyzing the transfer function between the acoustic source signal and a receiver located a known distance from the source. By performing the measurements with and without the bubbles deployed and comparing them, it is possible to determine the effects of the bubbles on the radiated sound levels.

Because the experiments were performed in a lake, which is in essence a large acoustic waveguide, it was necessary to take into account the modal structure of the lake itself when analyzing the data. The observed behavior is spatially and temporally dependent, and while the time-dependent effects can be partially removed when looking at measurements averaged over time, an observer will still experience the spatial structure of the sound pressure field. Thus, the measurements were made at enough receiver locations to uncover this some of this structure and the effects that the bubbles have on it. Measurements at a single position or even a handful of positions would not be sufficient to accurately describe the pressure field, even in the case of a shallow water waveguide at sea where drilling operations might take place. For these tests two receivers were positioned at 10 m and 65 m horizontal distance from the source with measurements made on each at water depths ranging from 2 m to 20 m.

A set of encapsulated bubble screen configurations were chosen to cover a representative portion of the pertinent parameter space. In general, the main parameters governing both encapsulated bubble screen systems are:

void fraction bubble or inner tube size bubble size distribution (monodisperse versus polydisperse)

The initial test matrix for the inner tube configurations to be used is shown in Table 1. Here, three inner tube sizes are referred to: large, medium, and small, with encapsulated air volumes of 1879.4 $cm^3$, 654.9 $cm^3$, and 185.2 $cm^3$, respectively. For our frequency band of interest, the corresponding wavelengths, λ, range from roughly 1.5 m to 150 m. Because these wavelengths are much larger than the dimensions of the inner tubes, the inner tubes can be considered as effective spherical volumes of air with radius defined by:

$$a_{eff} = \left(\frac{3V}{4\pi}\right)^{1/3}$$

where V is the volume of air inside the inner tube. Each inner tube size has a different spherical bubble resonance frequency, which is approximately given by the Minnaert frequency:

$$f_0 = \frac{1}{2\pi a_{eff}}\sqrt{\frac{3\gamma p_0}{\rho}}$$

where p0 is the hydrostatic pressure outside the inner tube, γ is the ratio of specific heats of air at constant pressure to constant volume, and ρ is the density of water. The predicted zero depth individual bubble resonance frequencies are 42.9 Hz, 61.0 Hz, and 92.9 Hz for the large, medium, and small sizes, respectively. Because of the variation of hydrostatic pressure with depth, the resonance frequencies take values up to 56.4 Hz, 80.1 Hz, and 122.0 Hz at a depth of 4 meters for each of the three sizes. In general, the actual resonance frequencies of the encapsulated bubbles are modified from the shell-less values depending on both the thickness and stiffness of the walls and the surface-area-to-volume ratio. In the case of the inner tubes, the walls are fairly thin and elastic, allowing for sufficient resonant motion of the encapsulated air volume for the absorption mechanism to occur. Additionally, the less contact the air volume has with the rubber walls, the more bubble-like it behaves, making a smaller surface-area-to-volume ratio more desirable. At the mean deployment depth of 2 meters, the predicted resonance frequencies become 44.3 Hz, 63.0 Hz, and 96.0 Hz, respectively. Note that future references in this paper to the predicted individual bubble resonance frequencies will quote these mid-depth values.

The void fraction is defined as the ratio of the volume of air, $V_{air}$, to the total volume of water and air, $V_{total}=V_{air}+V_{water}$, in the bubbly water region:

$$VF=V_{air}+V_{total}$$

The initial inner tube configuration matrix examines not only the effect of changing the void fraction, but also adding more than one inner tube size for a given void fraction, or using polydisperse as opposed to a monodisperse size distributions. As used herein the term "polydisperse" refers to an apparatus that includes gas-filled containers having two or more different volumes. As used herein the term "monodisperse" refers to an apparatus that includes gas-filled containers that all have about the same volume. The left column lists total (or global) void fraction while the right column lists the number of inner tubes needed to obtain that void fraction.

TABLE 1

Initial inner tube configuration matrix

| Void Fraction | Inner Tube Configuration |
|---|---|
| 0.02 | 150 large |
| 0.01 | 70 large |
| | 52 medium, 52 large |
| | 50 small, 50 medium, 50 large |
| 0.005 | 35 large |
| | 26 medium, 26 large |
| | 25 small, 25 medium, 25 large |

A second set of inner tube configurations was added to look at the effects of changing the inner tube volume and using equal void fraction polydisperse distributions, shown in Table 2. Here, a larger inner tube size, called jumbo, is added with an encapsulated air volume of 7763.2 $cm^3$ and a predicted individual bubble resonance frequency ranging from 26.1 Hz at zero depth to 35.1 Hz at 4 meters. The resonance frequency at the mean deployment depth of 2 meters is 27.7 Hz.

TABLE 2

Second inner tube configuration matrix

| Void Fraction | Inner Tube Configuration |
|---|---|
| 0.015 | 87 medium, 35 large, 10 jumbo |
| 0.01 | 35 large, 10 jumbo |
| 0.005 | 10 jumbo |
| | 35 large |
| | 87 medium |

The sub-resonant bubble cloud configuration matrix is displayed in Table 3. Here, the left column lists void fraction, which was estimated from the air flow rate to the diffuser hoses. The right column lists the diffuser hose pressure needed to obtain a particular air flow rate. For the two lowest hose pressures, the flow was too small to be measured so there was only an upper bound on the void fraction. In the case of the bubble clouds, only the effect of void fraction on the acoustic behavior is examined.

TABLE 3

Bubble cloud configurations

| Void Fraction | Diffuser-hose pressure (psi) |
|---|---|
| 0.026 | 54.0 |
| 0.02 | 15.4 |
| 0.006 | 4.2 |
| <0.006 | 2.5 |
| <0.006 | 2.2 |

Finally, the combined effect of using both an inner tube array and a sub-resonant bubble cloud were examined. These configurations are shown in Table 4, where the void fraction is listed in the left-hand column, the diffuser hose pressure in the middle column, and the inner tube number in the right-hand column. Equal void fractions for both the bubble cloud and various inner tube arrays were used.

TABLE 4

| Combination configurations | | |
|---|---|---|
| Void Fraction | Diffuser-hose pressure (psi) | Inner Tube Configuration |
| 0.01 | 4.2 | 10 jumbo |
| 0.015 | 4.2 | 35 large, 10 jumbo |
| 0.02 | 4.2 | 87 medium, 35 large, 10 jumbo |
| <0.006 | 2.5 | |
| <0.006 | 2.2 | |

For each case, measurements were made at both ranges from the sound source. Additionally, for each range, measurements were made at depths ranging from 2 m to 20 m in 2 m increments. The specific types of acoustical measurements made are briefly discussed in the following sub-sections.

Figure 2:
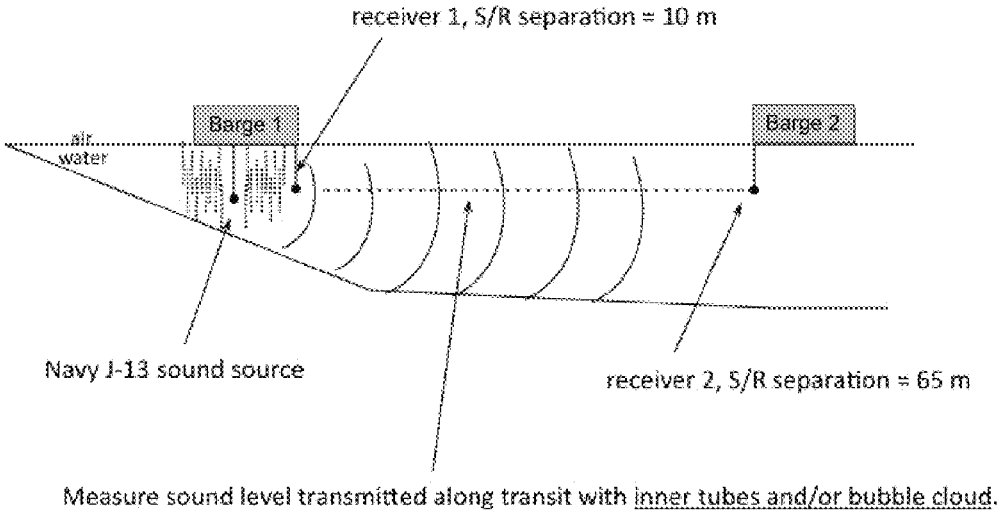
FIG. 2 depicts a schematic view of a testing experiment using a sound reducing device.

FIGS. 1 and 2 illustrate the conceptual design of the device. The sound source, a US Navy J-13 reference projector, was suspended in a well on the main barge. A hydrophone was deployed off the side of the main barge at a distance of 10 m from the sound source. A second hydrophone was deployed off the side of a second barge at a horizontal distance of 65 m from the sound source. The maximum range was limited by the source level of the J-13. The radiated sound level at both locations was then measured with no bubble screen present. Next, a bubble screen was deployed around the sound source and the sound level measurements were repeated. By comparing the nonbubble and bubble cases, the amount of reduction in radiated sound due to the bubble screen was determined.

Transfer function measurements were made between the source and receiver. The transfer function is defined here as a function of frequency:

$$Y(f)=H(f)X(f)$$

where Y is the power spectrum of the system output or received signal, X is the power spectrum of the system input source signal, and H is the transfer function. Because these quantities are in general complex, the transfer function is usually represented in terms of its amplitude and phase:

$$|H(f)| = \frac{|Y(f)|}{|X(f)|}$$

$$\phi(f) = \tan^{-1}\left(\frac{Y(f)}{X(f)}\right)$$

In this investigation, the transfer function was measured using a vector signal analyzer (VSA). The source and received signal were acquired by the VSA, where they were digitized and transformed to the frequency domain using a fast Fourier Transform (FFT). Each FFT had 1601 frequency bins in a frequency range of 60 Hz to 2 kHz. The FFTs were used to compute the transfer function onboard the VSA, and the amplitude and phase were recorded. Typically, the data was averaged over 30 consecutively-acquired spectra. The coherence spectrum was also monitored to ensure the quality of the data. This is given by:

$$\gamma(f) = \frac{X * Y}{\sqrt{|X||Y|}}$$

where the asterisk denotes the complex conjugate. For $\gamma=0$, the two signals are incoherent while for $\gamma=1$, they are coherent. Values in between indicate partial coherence. Typically, the data was considered to be good if the coherence is close to unity (>0.8).

Figure 3:
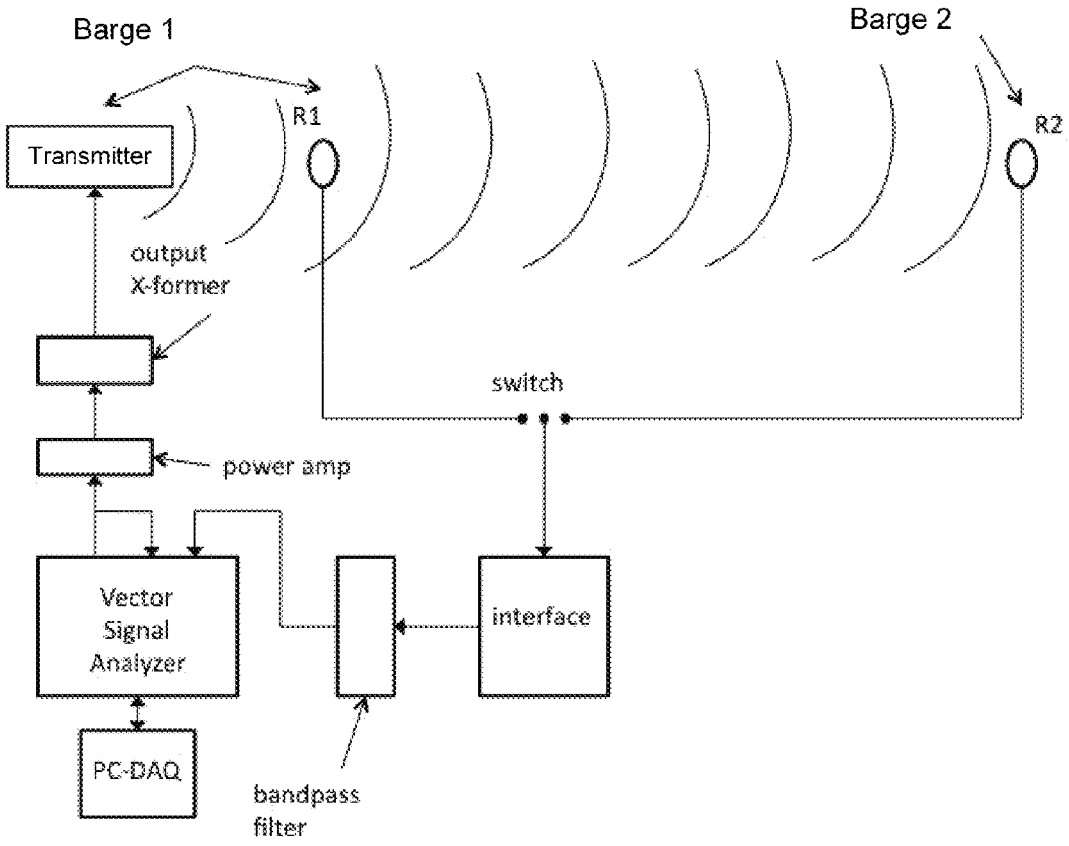
FIG. 3 depicts a schematic diagram of equipment setup for transfer function measurement.

The basic measurement set-up for the transfer function data collection is shown in FIG. 3. The arrows designate the direction of the signal path. The source signal was generated by an Agilent 89410-A VSA as a periodic chirp ranging from 60 Hz to 2 kHz, which was sent through a Crown CE4000 power amplifier to amplify the signal. In between the J-13 projector and the power amplifier was a custom-built output transformer which matched the electrical impedance of the J-13 input. This unit also housed a Pearson current transformer, allowing for continuous real-time monitoring of the electrical current to the source transducer to ensure that the J-13 was operated within its stated limits. The signal was received by one of two High Tech, Inc. HTI-90U hydrophones: one located on the main barge at a range of about 10 m from the sound source and one located on the STEP barge at a range of about 65 m. The received signal was sent through a custom-built interface to an electronic bandpass filter and then to the input of the VSA. After the spectrally-averaged transfer function was computed on the VSA, it was transfered to a computer via a GPIB connection for storage and later analysis.

In some instances, it was preferable to collect data in the time domain as opposed to the frequency domain. In these cases, the ambient sound level of the lake environment was such that the low-frequency part of the periodic chirp used for the transfer function analysis was obscured by the noise, even when running the J-13 at full power. Therefore, to obtain data at frequencies lower than 60 Hz, it was necessary to use time-coherent averaging of pure sinusoidal tones. Sources of the noise are wind, breaking waves, boat engines and propellers on the lake, and changes in hydrostatic pressure from passing wakes, among other things.

Figure 4:
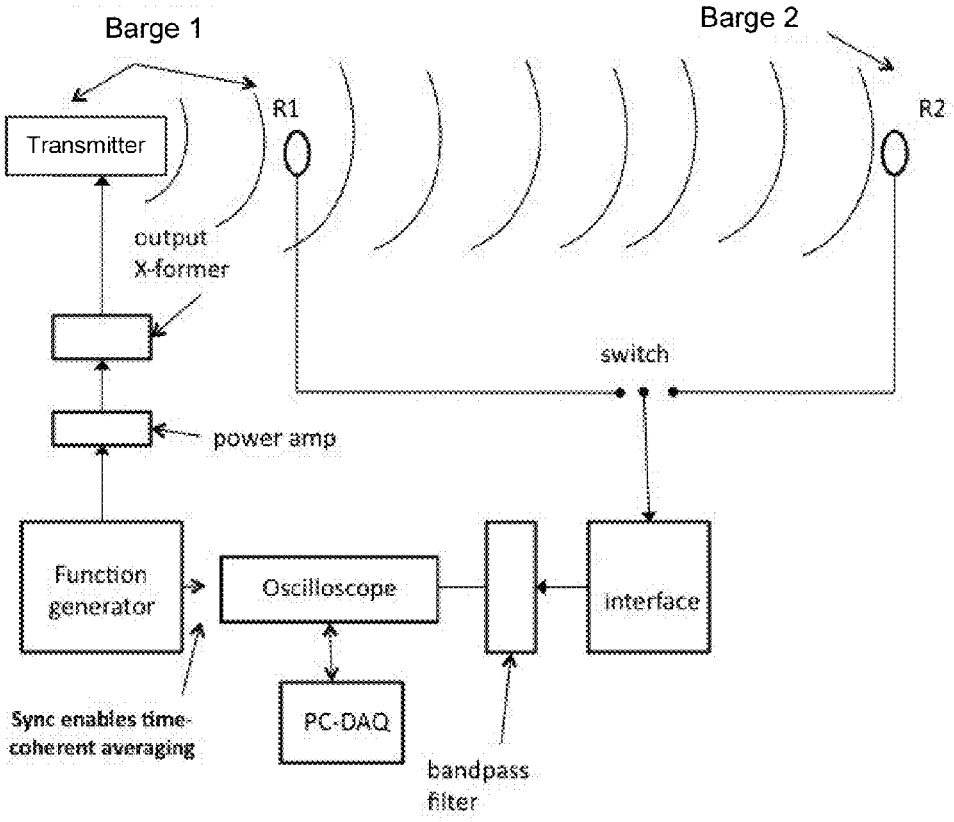
FIG. 4 depicts a schematic diagram of equipment setup for time-coherent averaging measurements with pure sinusoidal tones.

The experimental set-up which accomplished this technique is shown in FIG. 4. Again, the arrows in the diagram indicate the direction of the signal path. In this case, the source signal was generated by a Tektronix AFG310 function generator. A sync out from the function generator was connected to the external trigger input of a Tektronix TDS3012B oscilloscope so that the acquisition was triggered by the source signal. The oscilloscope was configured by a LabView program to acquire N waveforms from the selected receiver, which were transferred to the computer via GPIB. Averaging of the waveforms was later performed in post analysis.

Figure 5A:
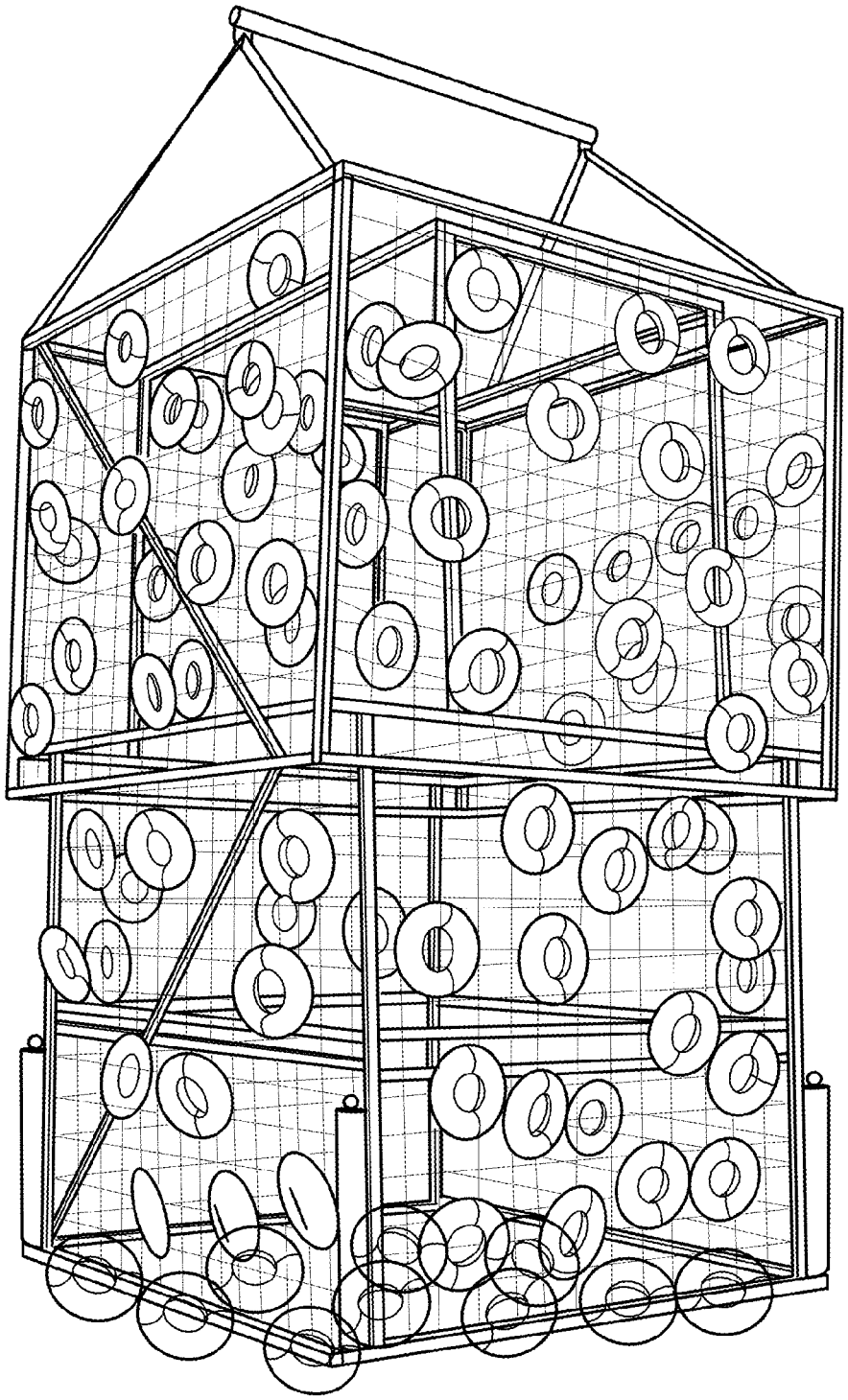
FIG. 5A depicts an embodiment of a sound reducing apparatus that includes a plurality of gas-filled containers coupled to a support.

The bubble screen apparatus, in one embodiment, uses a steel frame with netting to which the various gas-filled containers (e.g., inner tubes) were attached using cable ties. An exemplary apparatus is shown in FIG. 5A. In this particular configuration, 150 large inner tubes were equally divided among 4 outer side panels and two inner side panels. An additional 6 inner tubes were placed on the bottom panel. The inner tube positions on each panel were distributed in an unordered and homogeneous manner. The inner tubes on the inner panels were used to partially fill the volume of the frame. The sound source can be seen inside of the inner tube array through the netting in FIG. 5A. The sound source was located 2.6 meters below the surface of the water. The bottom of the frame extended approximately 4 meters below the surface. The various inner tube configurations described in Tables 1-4 were employed to determine the effects of void fraction, inner tube size, and the use of polydisperse versus monodisperse size distributions on the reduction of radiated sound.

Figure 5B:
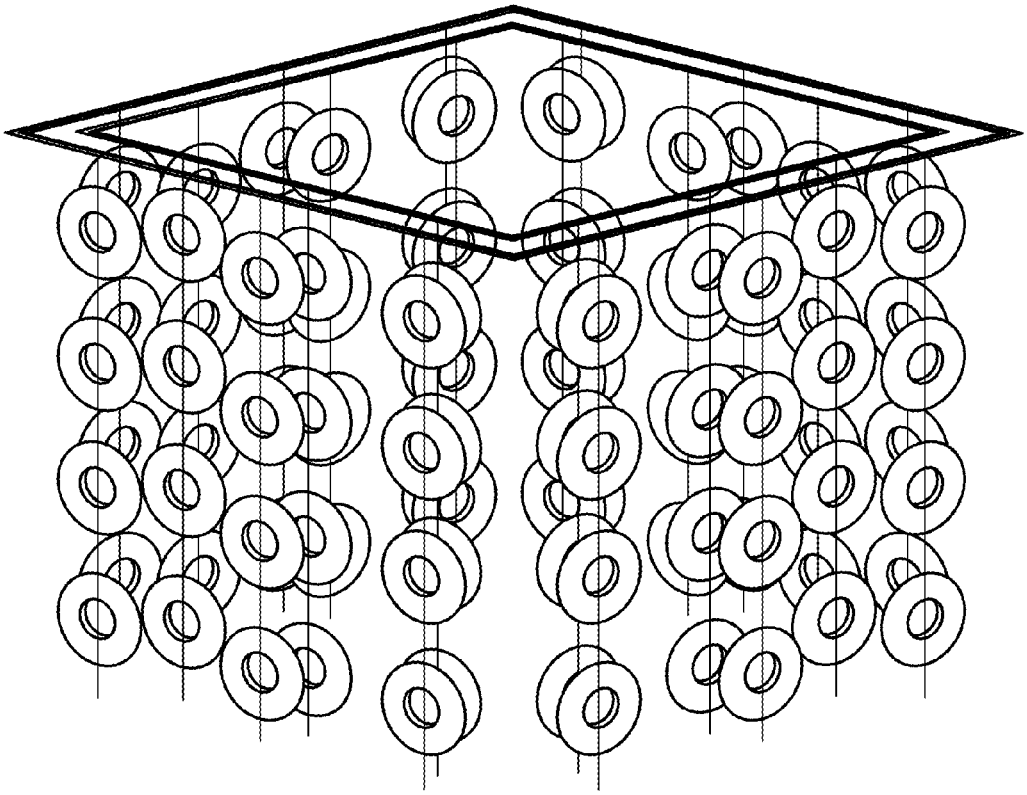
FIG. 5B depicts an alternate embodiment of a sound reducing apparatus that includes multiple curtains of gas-filled containers.

FIG. 5B depicts a schematic diagram of an alternate embodiment of a sound reducing device. The sound reducing device includes an inner layer of gas-filled containers and an outer layer of gas-filled containers. The gas-filled containers may be arranged in curtains with an inner curtain and an outer curtain, as depicted. In other embodiments, multiple layers of gas-filled devices may be used to reduce sound, including devices that has three, four, five, or more layers of gas-filled containers.

Figure 6A:
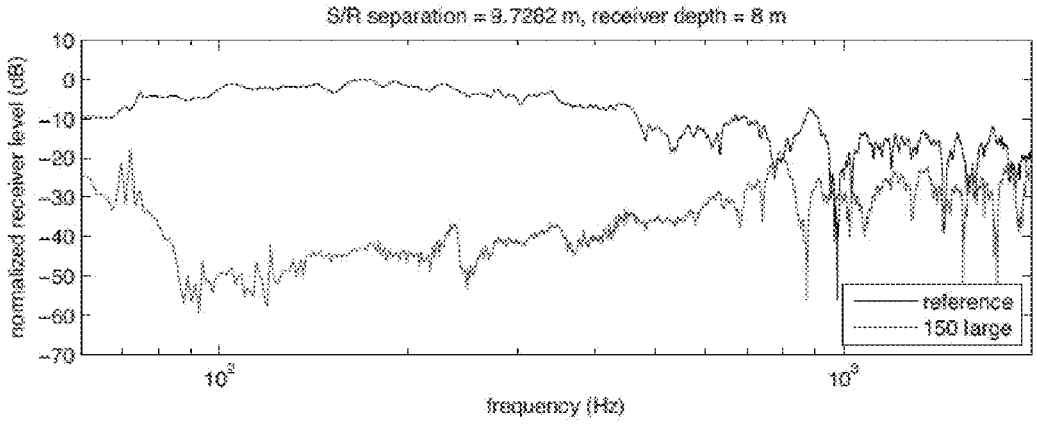
FIGS. 6A-6B depict comparisons of transfer function with and without gas-filled containers surrounding a sound source.
Figure 6B:
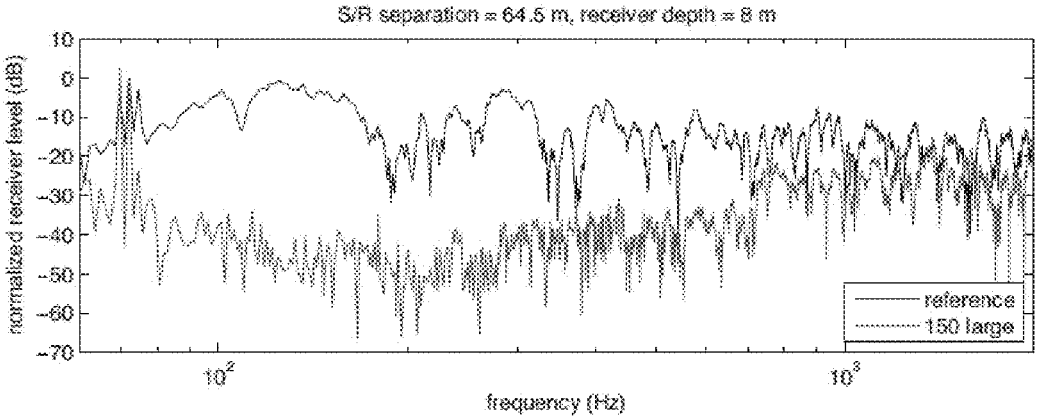

A quantitative comparison between the spectra of the underwater sound source with no inner tubes, referred to as the "reference case", and the sound source surrounded by inner tubes is shown in FIG. 6. FIG. 6A depicts the sound reduction at a source/receiver ("S/R") separation of about 9.7 meters, with the receiver at a depth of 8 m. FIG. 6B depicts the sound reduction at a S/R separation of about 64.5 meters, with the receiver at a depth of 8 m. Here, the transfer function is plotted for a single receiver depth at both receiver locations. Note that the frequency is plotted on a log scale. For these measurements, the sound source is surrounded by 150 large inner tubes, which have an equivalent spherical bubble radius of $a_{eff}$=7.7 cm, giving a void fraction of VF=0.02. At the 10 meter receiver location, the radiated sound is reduced by approximately 15 dB at 60 Hz, 40 dB at 100 Hz, and 20 dB at 500 Hz. The dip in the received level at 100 Hz occurs due to the inner tubes being close to their acoustic resonance at this frequency. The actual individual bubble resonance frequency is shifted upwards from the predicted value of 44.3 Hz due to effects of the finite thickness and stiffness of the inner tubes' rubber walls. At 60 meters the sound level reduction appears to be less; however, this is partly due to the signal being very close to the ambient lake noise floor. Another reason for this is that the sound field has a different modal structure at this range from the source. The spikes in the signal at 70 Hz, 72 Hz, and 74 Hz are due to mechanical and electrical noise generated on the test barges outside of the inner tube array.

Figure 7A:
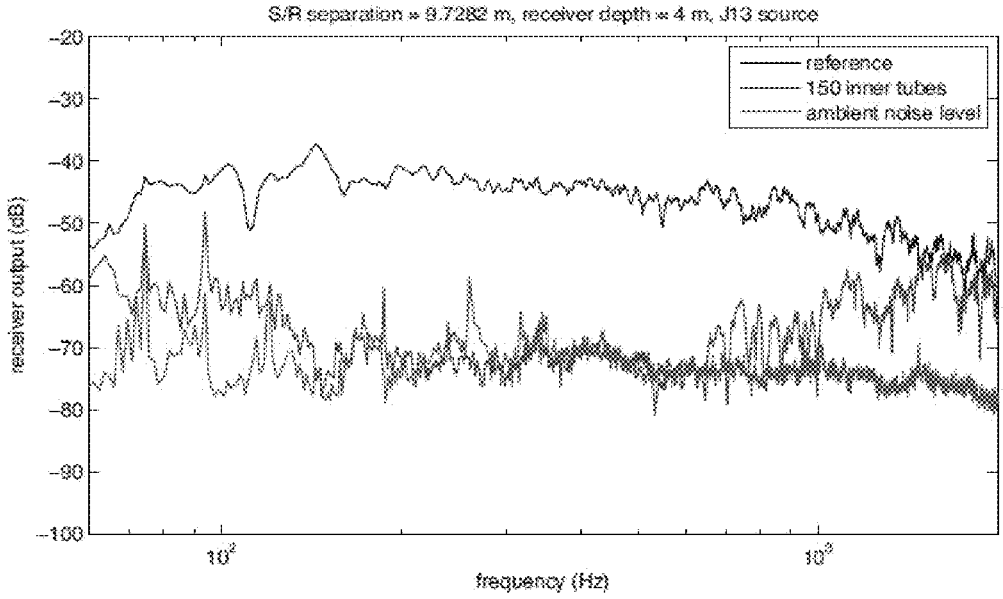
FIGS. 7A-7B depict comparisons of signal level to ambient lake noise level.
Figure 7B:
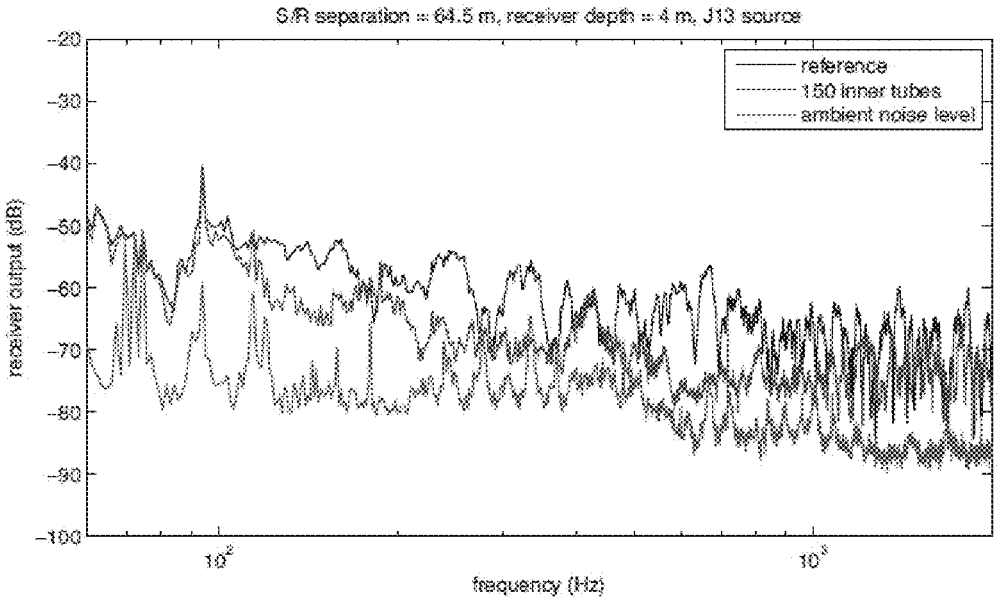

Comparison of the ambient noise and the received signals are shown in FIG. 7. FIG. 7A depicts ambient noise and the sound reduction at a S/R separation of about 9.7 meters, with the receiver at a depth of 4 m. FIG. 7B depicts ambient noise and the sound reduction at a S/R separation of about 64.5 meters, with the receiver at a depth of 4 m. The data plotted consists of the frequency spectrum of the hydrophone signal for three cases: sound source off, sound source on, and sound source surrounded by 150 inner tubes. The ambient lake noise level can vary quite a bit due to traffic on the lake in addition to variability in weather and wind speed. Nevertheless, one can see that several spectral features which are present in the data are also present in the ambient noise spectrum. Note that with this number of inner tubes surrounding the sound source, the received levels are at or below the noise level for several frequencies in this band. The signal-to-noise ratio can vary somewhat depending on the conditions at the lake. In general, however, the data from the 10 m receiver had a better coherence spectrum and its quality was less influenced by the various noise-generating processes in the lake than the 65 m receiver. It is important to note that the ambient noise spectrum is not fully understood as it is distinct for different times and not all noise sources can be accounted for. A more in-depth study of the ambient noise in the lake is required to better explain its spectral features and their relation to the reference and inner tube data.

Figure 8A:
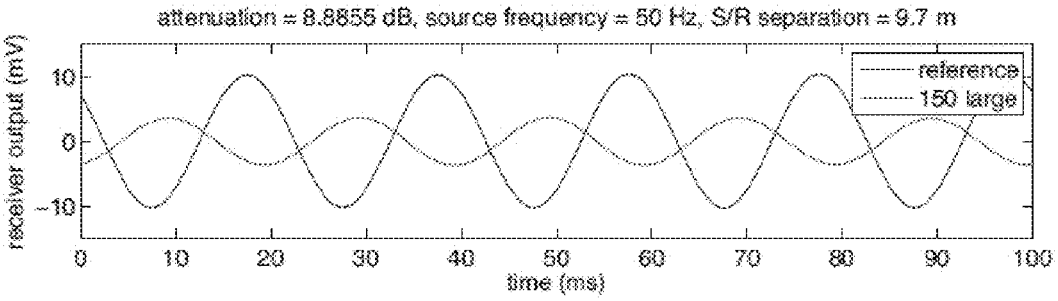
FIGS. 8A-8C depict time-coherent averaging of pure tone source signals at 50 Hz, 100 Hz, and 200 Hz with a receiver located about 10 meters from the sound source.
Figure 8B:
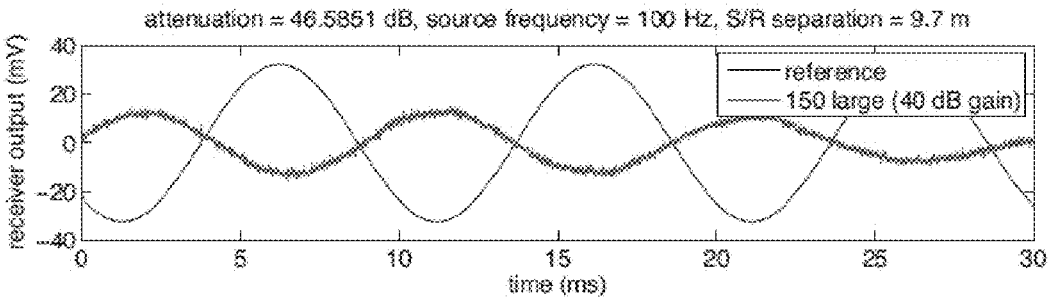
Figure 8C:
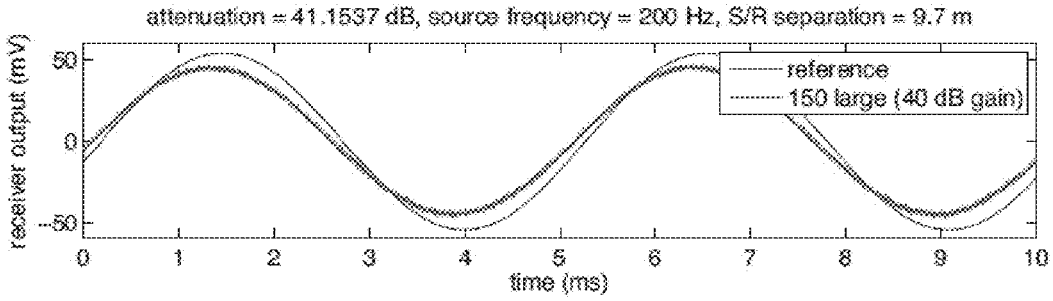
Figure 9A:
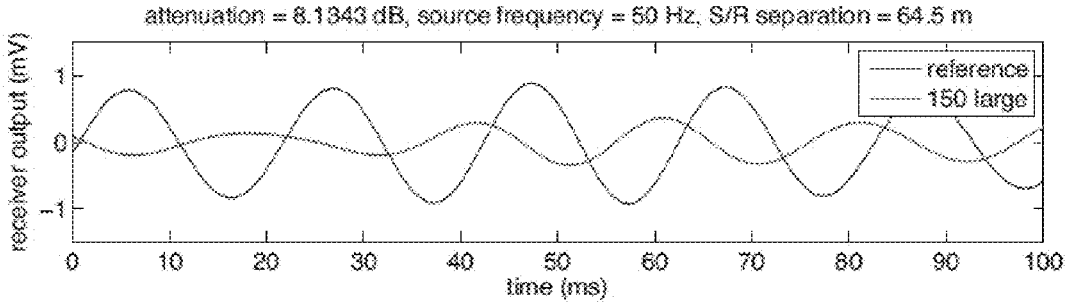
FIGS. 9A-9C depict time-coherent averaging of pure tone source signals at 50 Hz, 100 Hz, and 200 Hz with a receiver located about 65 meters from the sound source.
Figure 9B:
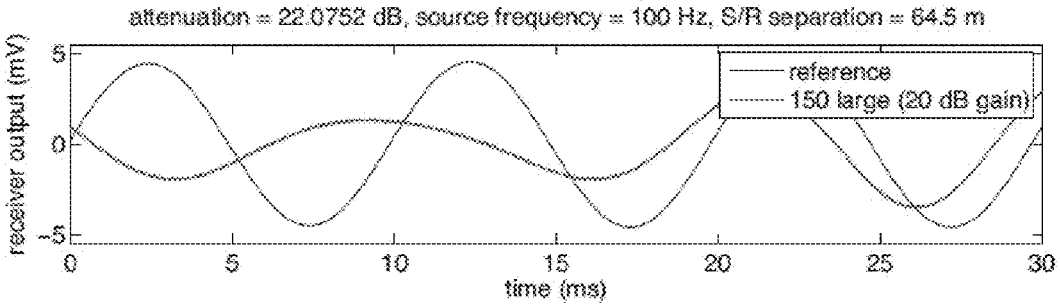
Figure 9C:
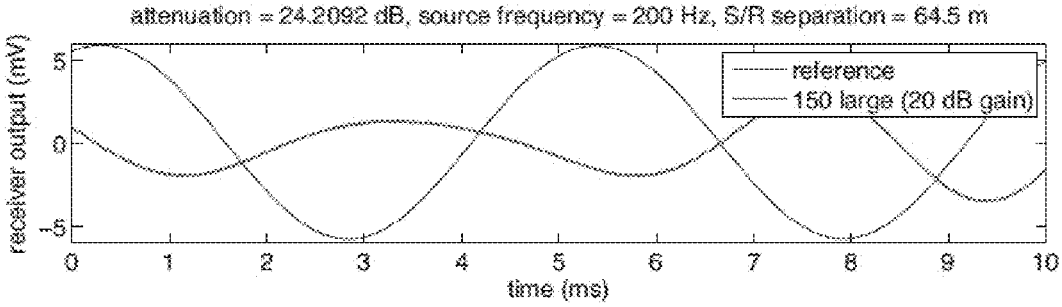
Figure 10:
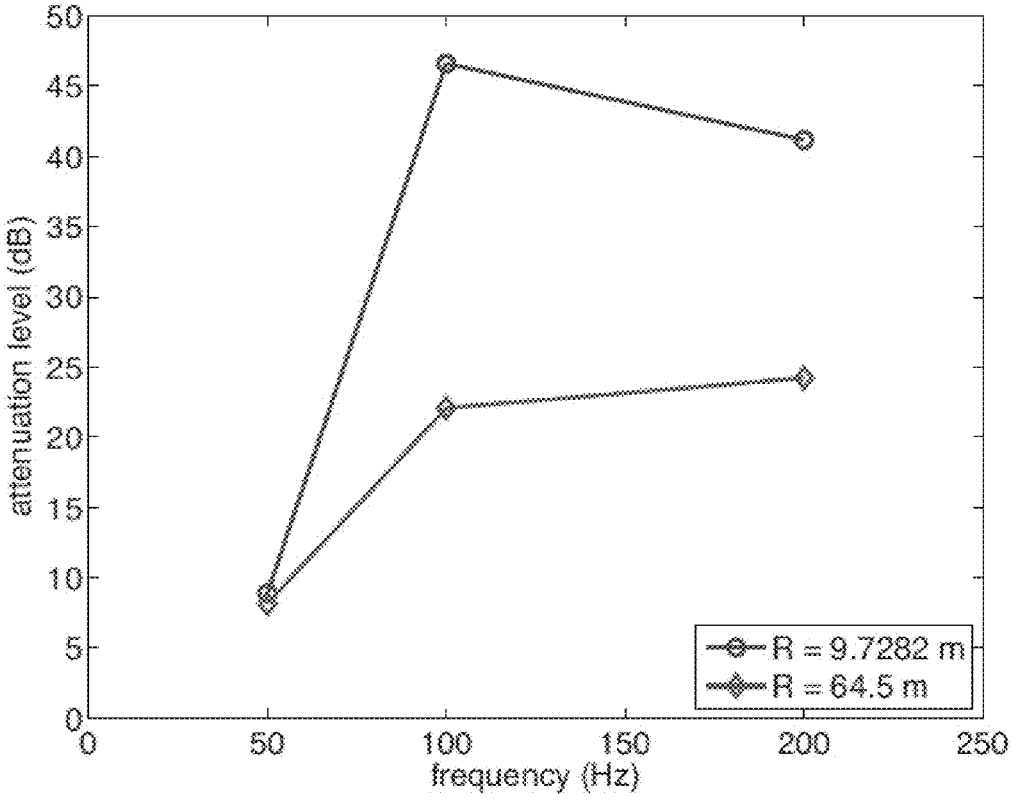
FIG. 10 depicts measured attenuation level in the 50 Hz to 200 Hz frequency range using time-coherent averaged data.

In an attempt to better extract the signal from the ambient noise, measurements were made using single-frequency sinusoidal source tones. The received waveform was acquired 64 times, and time-coherent averaging was performed. The results of this analysis are shown in FIGS. 8 and 9 for source frequencies of 50 Hz, 100 Hz, and 200 Hz. FIGS. 8A, 8B and 8C depict results of tests performed with a S/R separation of about 10 m at 50 Hz, 100 Hz, and 200 Hz respectively. FIGS. 9A, 9B and 9C depict results of tests performed with a S/R separation of about 65 m at 50 Hz, 100 Hz, and 200 Hz respectively. The data from the 10 meter receiver displays better spatial coherence than the 65 meter receiver because both the sound source and the 10 meter receiver were suspended from the main barge, and thus have only minor relative motion between them. For the 65 meter receiver, which was located at the second barge, the relative motion between the two barges changed the location of the receiver in the waveguide between each acquisition. This had the effect of making the pressure field non-stationary in time, leading to averaged waveforms that display multiple-frequency content, as seen in FIGS. 9A-9C. By comparing the amplitudes of the inner tube cases to the reference cases for each frequency, the amount of attenuation is determined. The measured attenuation level for each receiver location is plotted in FIG. 10. Again, it is important to emphasize that the values measured at the 10 meter receiver are more reliable since there were less experimental issues, and this may account for the fact that the apparent attenuation at 65 meters is not as large.

To isolate the effect of altering the void fraction, only the large inner tube size was used, and the number of inner tubes attached to the frame was varied. As the void fraction is increased, the received level decreases at both locations, thus reduction in radiated pressure occurs over all receiver depths. The greatest reduction for any particular case occurs in the frequency range from about 70 Hz to just above 500 Hz.

Figure 11:
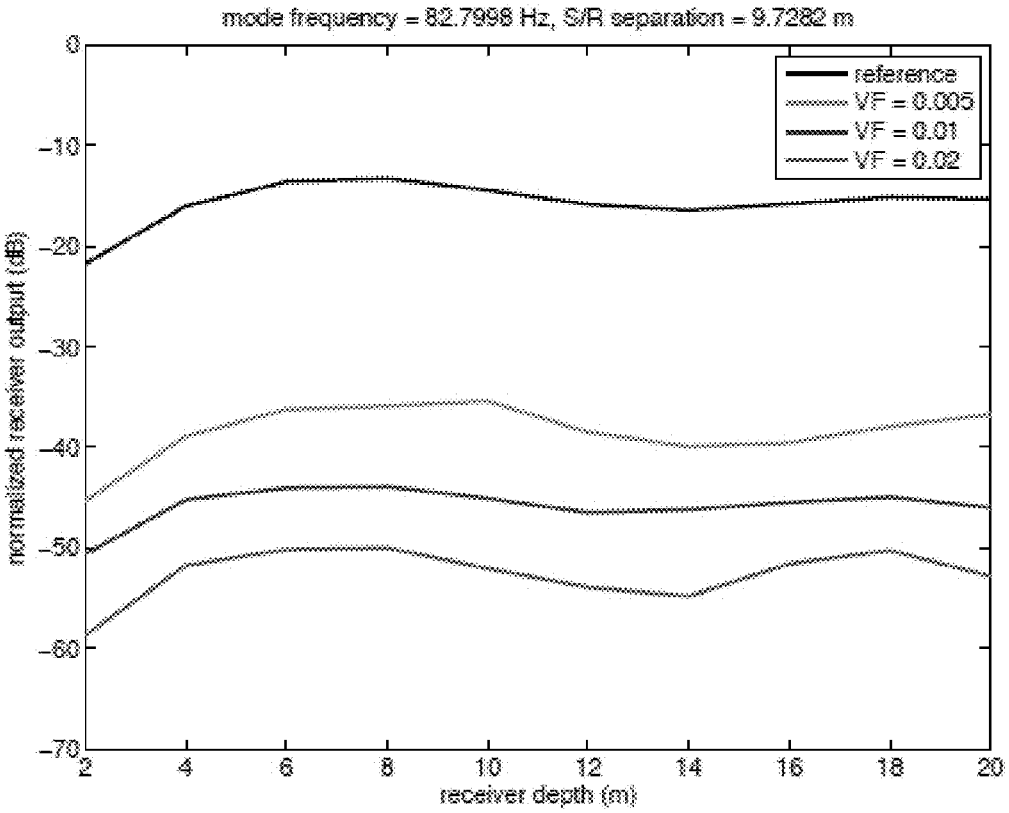
FIG. 11 depicts the resonant longitudinal lake mode at 82.8 Hz.
Figure 12:
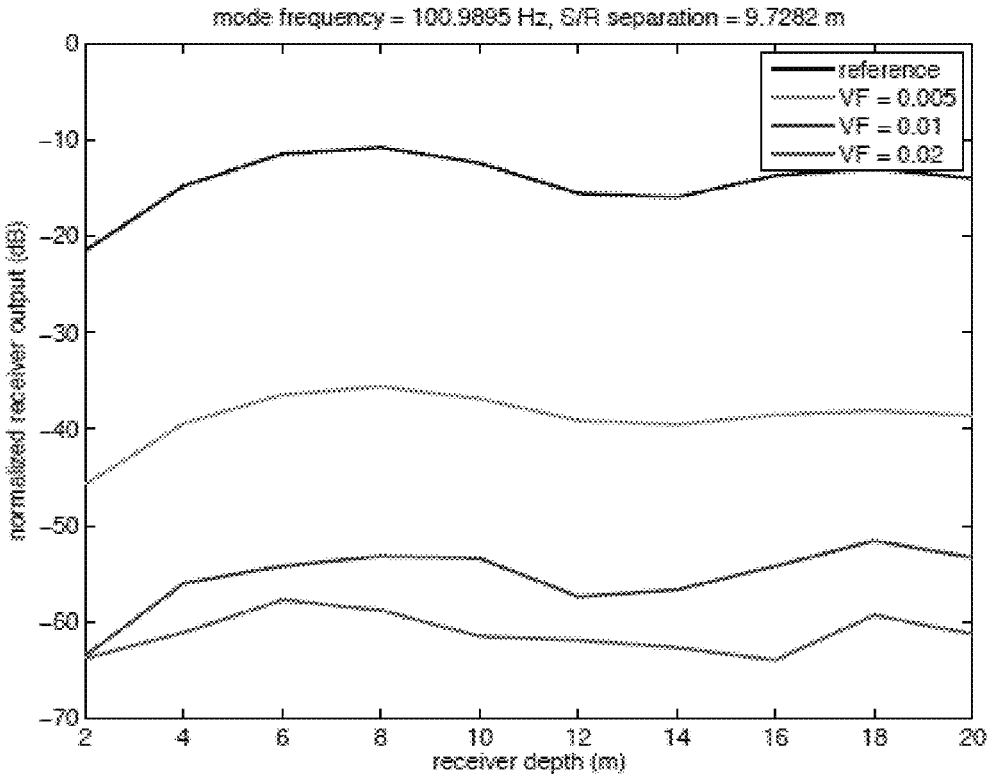
FIG. 12 depicts the resonant longitudinal lake mode at 101.0 Hz.
Figure 13:
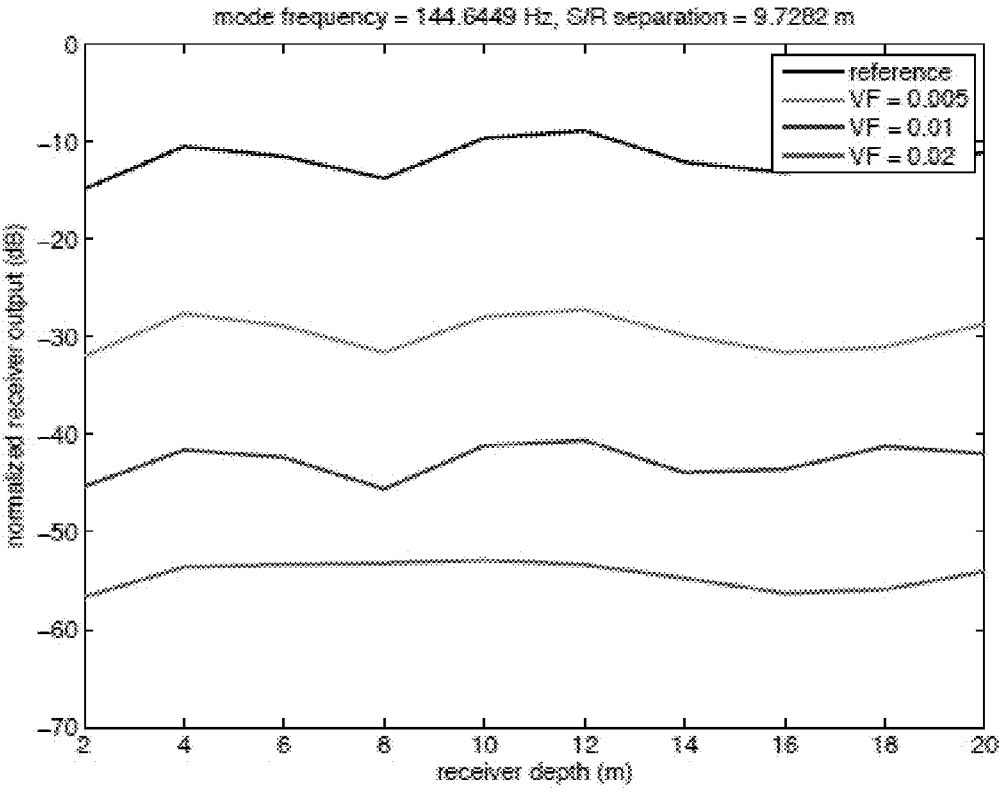
FIG. 13 depicts the resonant longitudinal lake mode at 144.6 Hz.

In FIGS. 11 through 13 the receiver output at the 10 meter range is plotted versus receiver depth for fixed frequency. The periodic variation of sound pressure with depth at each particular frequency is again indicative of the modal structure of the sound field. These three plots correspond to three low frequency modes with wavelengths ranging between 10 m and 20 m. Note that even for the lowest void fraction case, the amount of attenuation is greater than 10 dB for frequencies between 80 Hz and 150 Hz.

Figure 14:
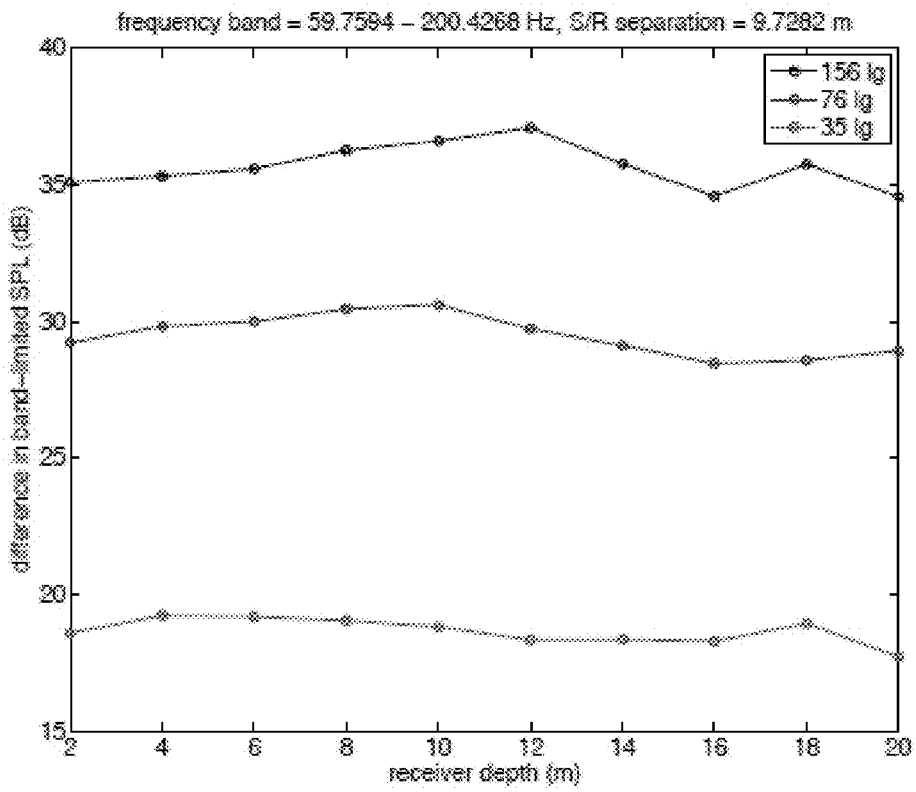
FIG. 14 depicts band-limited SPL reduction versus receiver depth for three void fractions of gas-filled containers at a separation of about 10 m.
Figure 15:
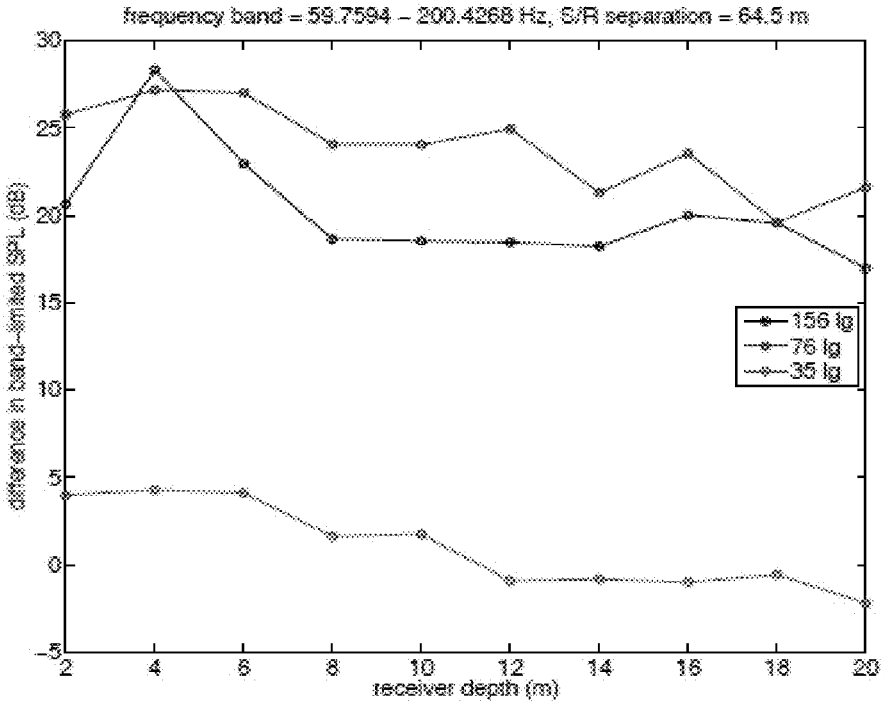
FIG. 15 depicts band-limited SPL reduction versus receiver depth for three void fractions of gas-filled containers at a separation of about 65 m.

The average sound pressure level (SPL) reduction was computed in the frequency band from 60 Hz to 200 Hz by averaging over the measured sound pressures in that frequency range for both the reference and inner tube cases and then taking their difference. FIGS. 14 and 15 compare the band-limited SPL reduction for the three void fraction cases at two horizontal receiver distances. At the 9.73 receiver location the average attenuation levels in the 60 Hz to 200 Hz band are 18 dB, 29 dB, and 35 dB for void fractions of 0.005, 0.01, and 0.02, respectively, and the amount of reduction appears to be fairly constant with depth. In the case of the 64.5 meter data, the attenuation levels corresponding to the two lower void fractions follow a similar trend of increasing with void fraction. Because the signal level in this frequency range is at or below the ambient noise level for the high void fraction case, the SPL calculation may not be indicative of the actual attenuation level in that instance.

To isolate the effect of inner tube size on the radiated spectrum, the void fraction was fixed at VF=0.005, ensuring that the received signals had a great enough amplitude such that they overcame the ambient lake noise level. Three inner tube sizes were used in monodisperse distributions. These were jumbo, large, and medium, which had predicted individual bubble resonance frequencies of 31.0 Hz, 49.7 Hz, and 70.7 Hz, respectively, at the mean deployment depth of 2 meters. The observed dip in the measured spectrum is interpreted to correspond to the individual bubble resonance frequency, thus, the dip should shift left or right along the frequency axis for an increase or decrease in encapsulated air volume, respectively.

Figure 16:
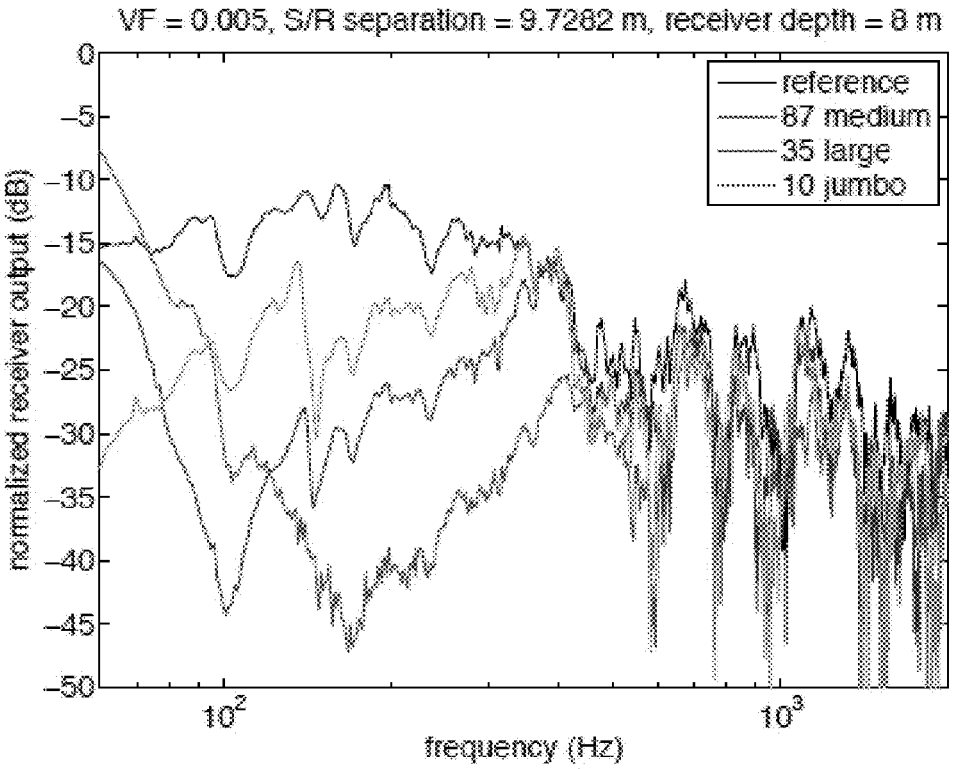
FIG. 16 depicts measured frequency response for various monodisperse gas-filled containers at a separation of about 10 m.
Figure 17:
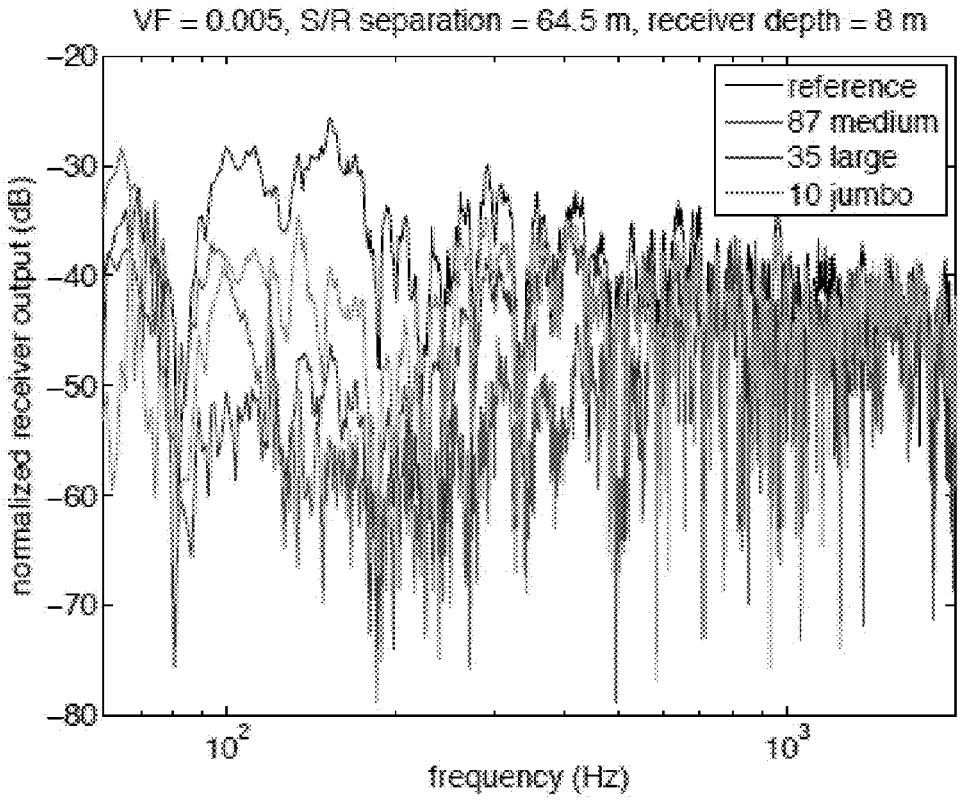
FIG. 17 depicts measured frequency response for various monodisperse gas-filled containers at a separation of about 65 m.

Comparison of measured transfer functions for separate monodisperse distributions of the three inner tube sizes is shown in FIGS. 16 and 17 for receivers located at 10 meters and 65 meters at a depth of 8 meters. The dip in the spectrum clearly shifts to a lower frequency as the distribution is changed from 87 medium inner tubes to 35 large inner tubes. For the case of the jumbo inner tubes, the frequency at which the dip occurs appears to be lower than 60 Hz. During pre-testing setup, it was determined that 60 Hz was the lower limit for which the J-13 projector could efficiently get sound into the water with a periodic chirp signal so this is the lower limit in our experiment.

Figure 18:
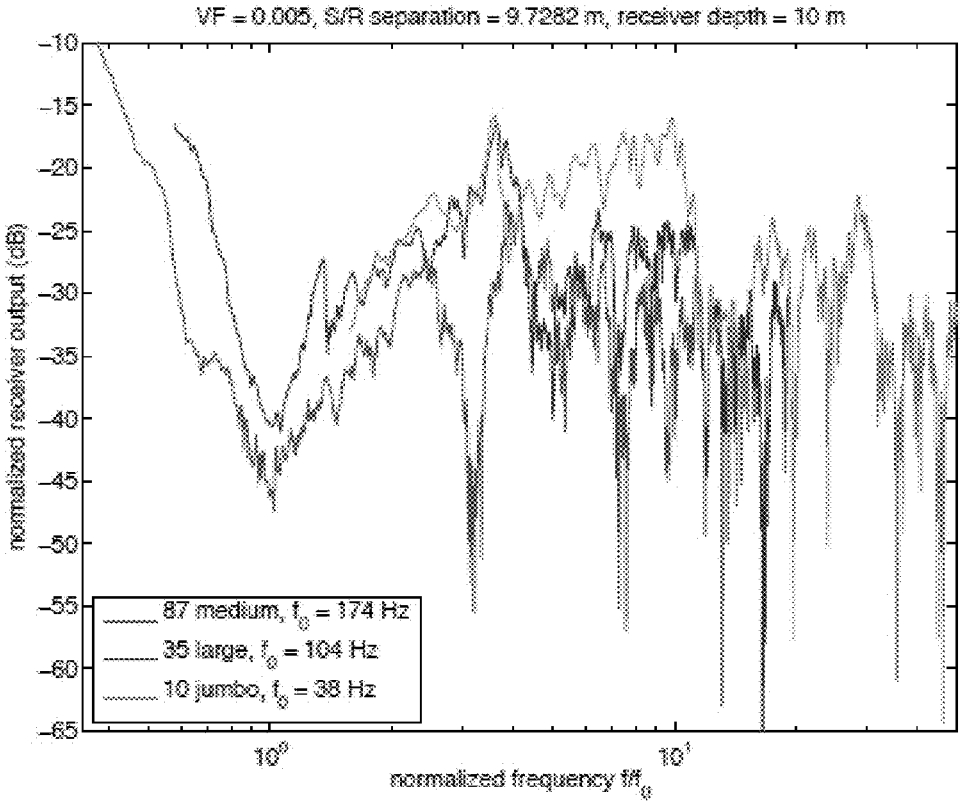
FIG. 18 depicts transfer function versus frequency normalized by its respective gas-filled container resonance frequency.

In FIG. 18, the frequency axes for the medium and large cases are normalized by their respective frequency minima, which are at 174 Hz and 104 Hz. These are modified from the predicted individual bubble resonance frequencies primarily due to the presence of the rubber walls encapsulating the air volumes. Note that the shapes of the two medium and large inner tube spectra are lined up. The normalization factor was then adjusted for the jumbo case such that its spectrum lined up with the two previous spectra, indicating that for the jumbo size the resonance frequency should be around 40 Hz.

Figure 19:
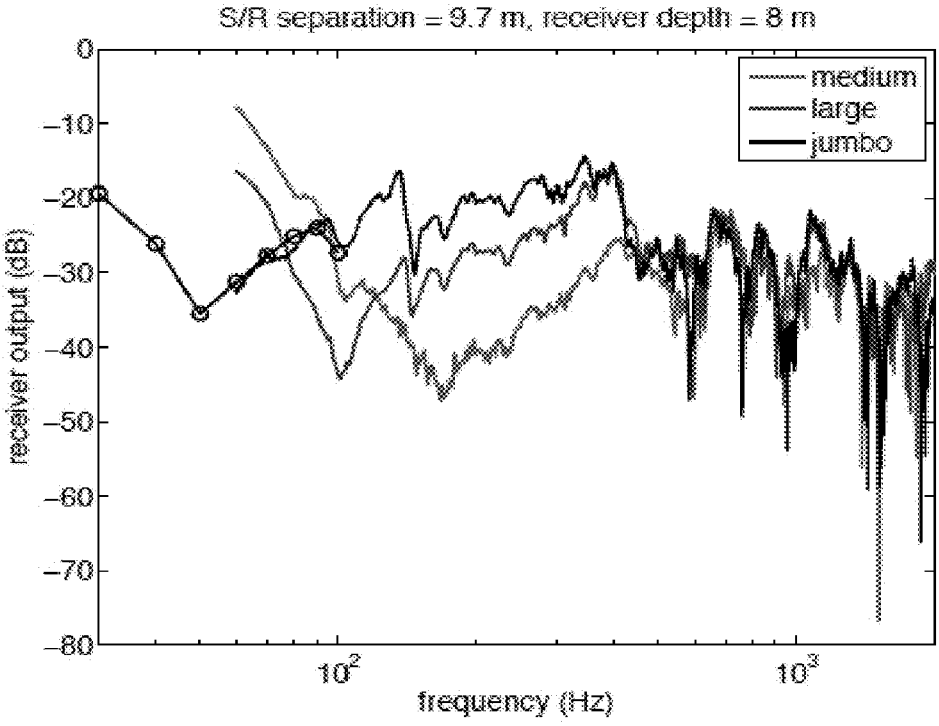
FIG. 19 depicts the extension of the jumbo inner tube frequency response to sub-60 Hz frequencies with time-coherent averaging of pure tone data (open circles)

To map out the sub-60 Hz of the jumbo inner tube array, the time-coherent averaging technique was used with single-frequency sinusoidal tones ranging from 30 Hz to 100 Hz in steps of 10 Hz. This tone data is overlaid on top of the transfer function in FIG. 19, extending the curve for the jumbo inner tube case to low enough frequencies such that the frequency minimum is resolved, which appears to be around 50 Hz. Clearly, increasing the inner tube volume has the effect of extending the range of high attenuation to lower frequencies, and the overall amount of attenuation can be improved by increasing the number of inner tubes or the void fraction.

Inner tube distributions combining multiple sizes were employed to determine if attenuation over a broader range of frequencies could be achieved. Two possibilities considered for constructing a polydisperse distribution out of discrete inner tube sizes were to use either equal numbers of each size or equal void fraction for each size.

Although a Commander and Prosperetti model predicts that the range of high attenuation ought to extend to a greater number of frequencies when adding multiple bubble sizes, there are some complications that can arise when considering multiple discrete bubble size populations. As a simple case, consider a bubble size distribution that consists of two Gaussian distributions centered about spherical bubble radii $a_1$ and $a_2$. These radii are such that $a_1$ is greater than $a_2$ and their resonance frequencies are $f_1$ and $f_2$, where $f_1<f_2$. For frequencies below $f_1$, the Commander and Prosperetti model predicts that the attenuation is very low because all of the bubbles oscillate in phase with the incident sound wave. Above $f_1$ there is significant attenuation due to the bubble population centered around $a_1$, which oscillates out of phase with the sound wave; however, because the population centered around $a_2$ is still below resonance, this group of bubbles oscillates in phase with the wave. These in-phase oscillations can reduce the amount of attenuation observed in the frequency band between $f_1$ and $f_2$. These "short-circuiting" effects were observed in the data although they could potentially be overcome by increasing the void fraction either globally or for the various sub-populations.

Figure 20:
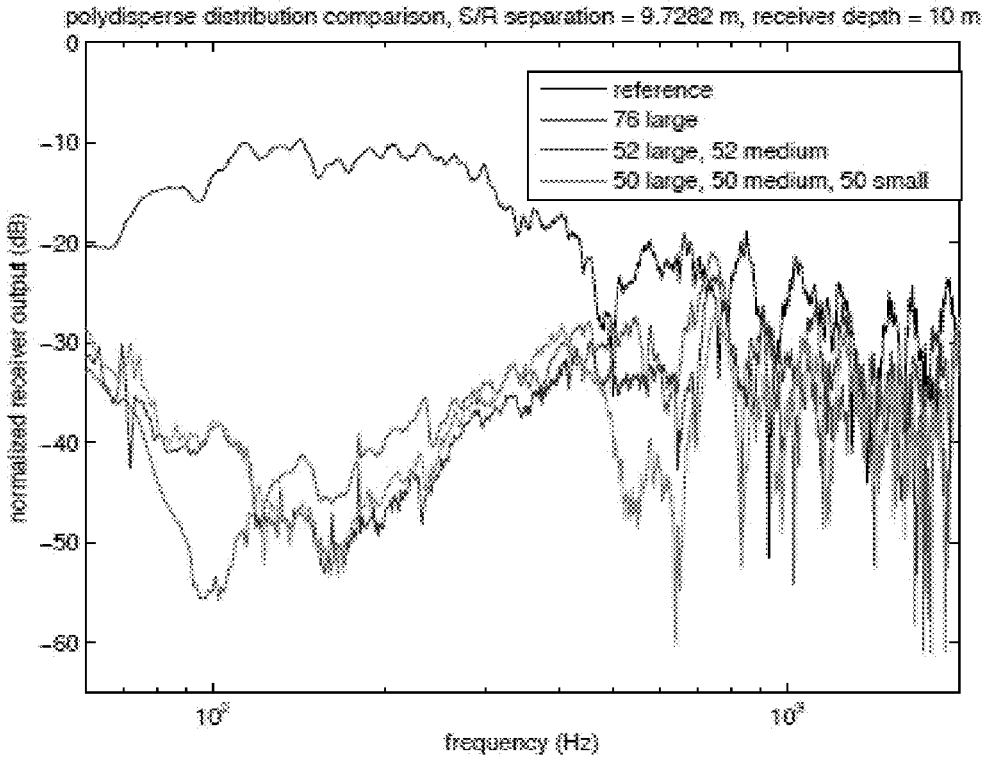
FIG. 20 depicts a comparison showing received level for mono- and polydisperse gas-filled container distributions with an equal number of gas-filled containers and at a fixed global void fraction with a separation of about 10 m.
Figure 21:
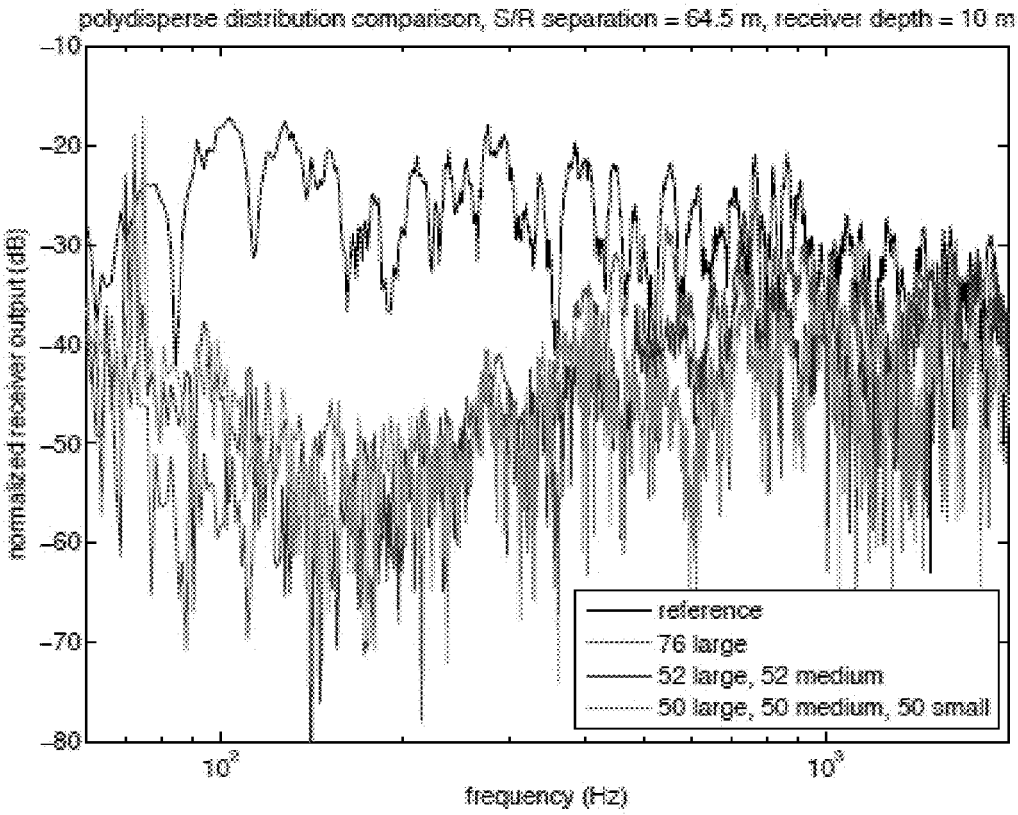
FIG. 21 depicts a comparison showing received level for mono- and polydisperse gas-filled container distributions with an equal number of gas-filled containers and at a fixed global void fraction with a separation of about 65 m.

For the first series of polydisperse distribution tests, equal numbers of each inner tube size were used. For a fixed global void fraction of VF=0.01, three distributions were employed: 70 large inner tubes; 52 large and 52 medium inner tubes; and 50 large, 50 medium, and 50 small inner tubes. Measured transfer functions for each of these cases are shown in FIGS. 20 and 21. Note that the dip in amplitude that occurs near 100 Hz in the monodisperse case is absent in the two polydisperse cases. This is due to the short-circuiting mechanism described previously. Combining the medium and large inner tubes results in additional attenuation of a few dB for frequencies above 100 Hz compared to the monodisperse large case. Adding the small inner tube population produces a pronounced dip of 10 dB or more from 400 Hz to about 500 Hz, and there is slight decrease in attenuation around 300 Hz due to short-circuiting. Needless to say, the spectrum becomes more complex when multiple inner tube size distributions are used.

Figure 22:
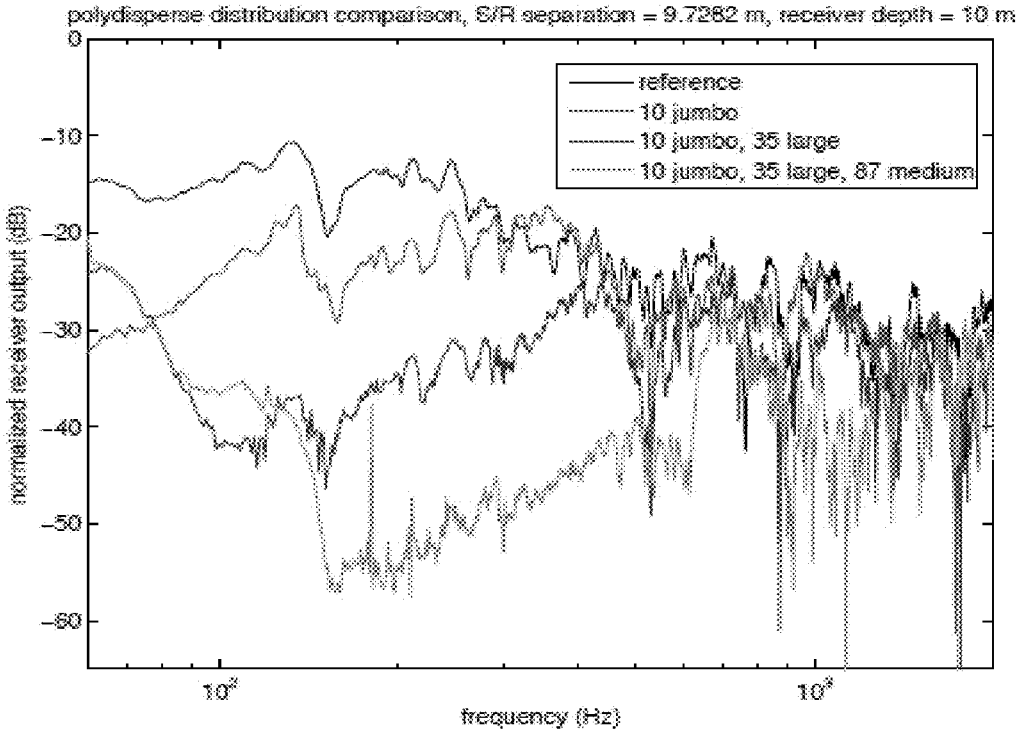
FIG. 22 depicts a comparison showing received level for mono- and polydisperse gas-filled container distributions with each gas-filled container size providing an equal contribution to the global void fraction, the receiver separation was at about 10 m.
Figure 23:
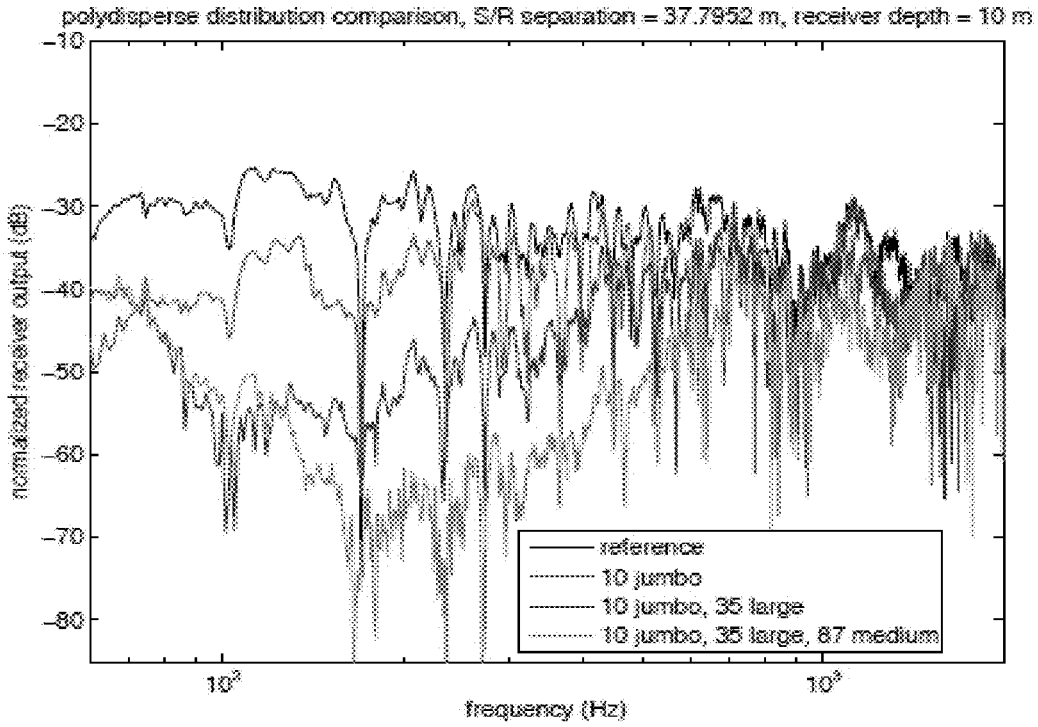
FIG. 23 depicts a comparison showing received level for mono- and polydisperse gas-filled container distributions with each gas-filled container size providing an equal contribution to the global void fraction, the receiver separation was at about 65 m.

An additional set of experiments on polydisperse inner tube distributions was performed using an equal void fraction for each inner tube sub-population. In these cases, the global void fraction is not fixed, but increased from 0.005 to 0.015. The void fraction for each sub-population was VF=0.005. Also, to extend the attenuation to lower frequencies, the jumbo, large, and medium sizes were used. The different cases were: 10 jumbo inner tubes, 10 jumbo and 35 large inner tubes, and 10 jumbo, 35 large, and 87 medium inner tubes. The transfer functions for each of these cases are shown in FIGS. 22 and 23. Although adding the large and medium inner tubes to the jumbo distribution decreases the low-frequency attenuation, there is still roughly 10 dB of reduction at 60 Hz. What is gained is a great increase in attenuation for frequencies over 80 Hz. Although this can be partially attributed to the addition of the smaller inner tube sizes, the greatest effect likely comes from the increase in the global void fraction.

Figure 24:
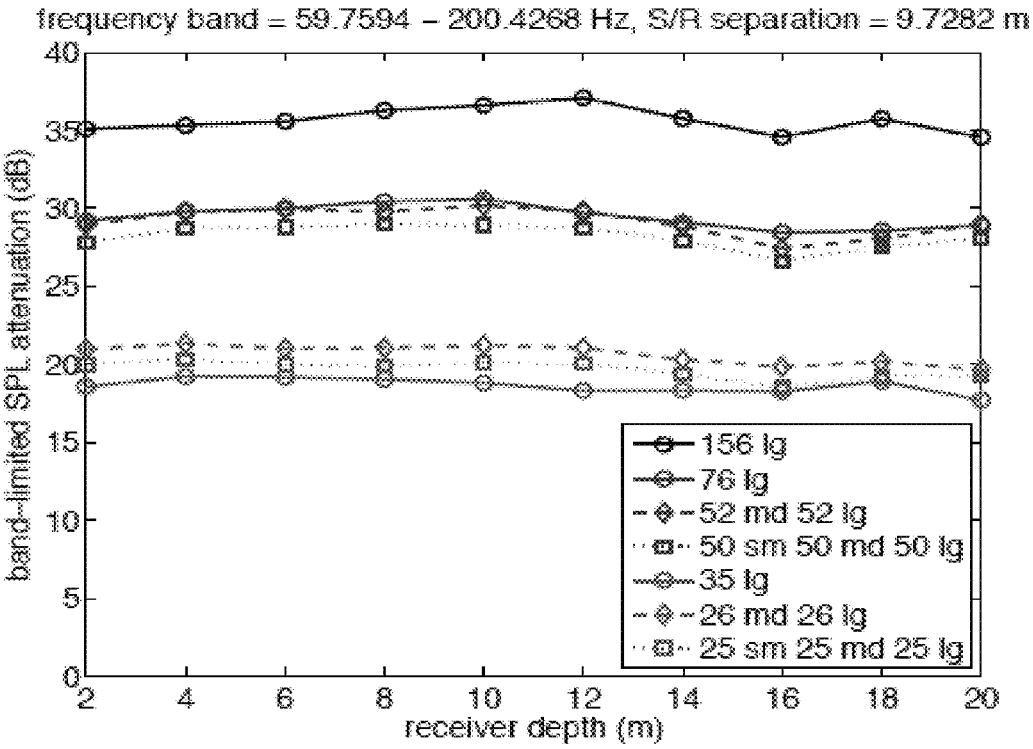
FIG. 24 depicts a comparison of band-limited SPL reduction for various monodisperse and polydisperse cases.

The global void fraction has the primary effect on the amount of observed attenuation, and the combination of multiple inner tubes sizes has a less significant influence on the radiated spectrum. This is illustrated in FIG. 24. Here, band-limited SPL reduction is plotted for three monodisperse cases at void fractions of 0.005, 0.01, and 0.02 and four polydisperse cases, two each at VF=0.005 and VF=0.01. The frequency band used in this computation is from 60 Hz to 200 Hz. The change from a monodisperse to a polydisperse distribution for any given void fraction results in a variation of only one or two dB in reduction whereas doubling the void fraction can increase this amount by as much as 10 dB.

The bubble screen apparatus only required slight modification to incorporate the generation of a cloud of freely-rising bubbles. Two cloth-covered ceramic diffuser hose rings were attached to the steel frame approximately 0.5 meters below the location of the J-13 projector and approximately 3.5 meters below the surface of the water. Continuous air flow was delivered to the diffuser hoses by a low-pressure, high flow rate, diesel-powered air compressor. The flow rate for each diffuser hose ring was regulated manually by an adjustable flow meter, which also served the purpose of monitoring the air flow rate. The regulator assembly also included a pressure gauge for each ring to monitor the air pressure as well as valves for shutting off the air flow to each ring. Additionally, a submersible electronic pressure sensor was attached to one of the diffuser hose rings to measure the air pressure on the hose at depth. The mean radius of the bubbles produced in this manner was previously determined to be approximately a=0:25 cm.

The bubble cloud void fraction was essentially the only controllable physical parameter for the system. Estimates of the void fraction in the bubble cloud were obtained using the measured air flow rate and the initial rise time of the bubble cloud for a given set of operating parameters. The flow rate was varied from 22 cfm to less than 5 cfm, which was the lower limit of the scale on the flow meter used. These flow rates corresponded to void fractions ranging from less than 0.006 up to 0.026.

Figure 25A:
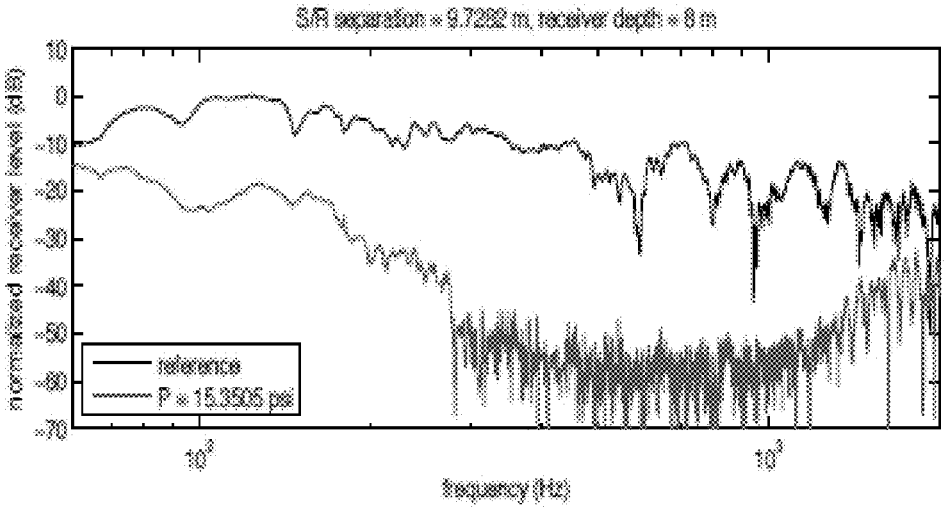
FIG. 25 depicts a comparison of transfer functions with and without a bubble cloud surrounding the sound source.
Figure 25B:
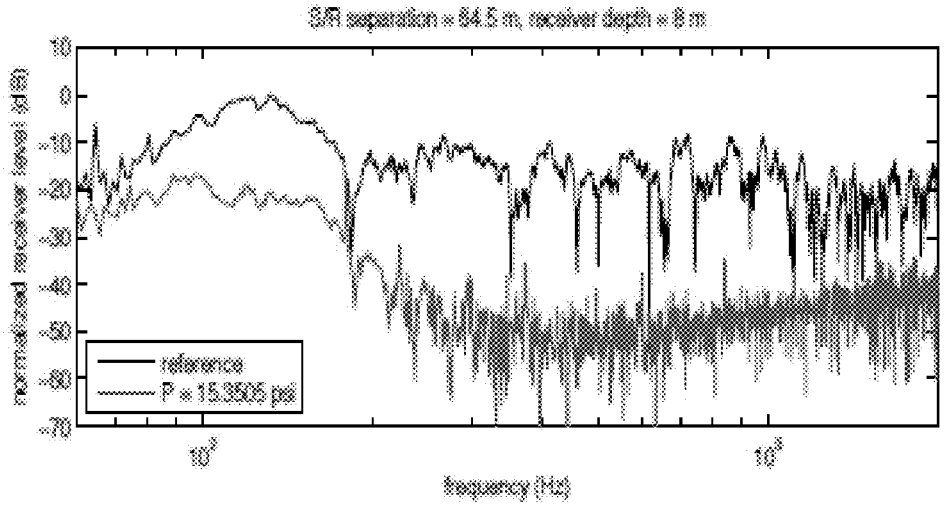

A quantitative comparison of measured transfer functions with and without a bubble cloud enclosing the sound source is shown in FIG. 25. The bubble cloud in this case had a void fraction of approximately 0.02, equivalent to the void fraction of the 150 inner tube array. At the meter receiver location (FIG. 25A), a reduction in radiated sound of 4 dB is observed at 60 Hz, and the attenuation increases to 23 dB at 100 Hz. As opposed to the higher levels of attenuation observed in the inner tube case due to their acoustic resonance at low frequencies, the reduction here is primarily due to acoustic impedance mismatching. For frequencies between roughly 350 Hz to just over 1 kHz, the received level drops off to below the ambient noise level. In this frequency band the attenuation is due to a combination of acoustic impedance mismatching and the acoustic resonance of the freely-rising bubbles. At higher frequencies the received level begins to approach the bubble-free case as the resonance mechanism has less of an effect. Although the received source level is much closer to the ambient noise level at the more distant receiver location (FIG. 25B), similar behavior was observed.

Figure 26:
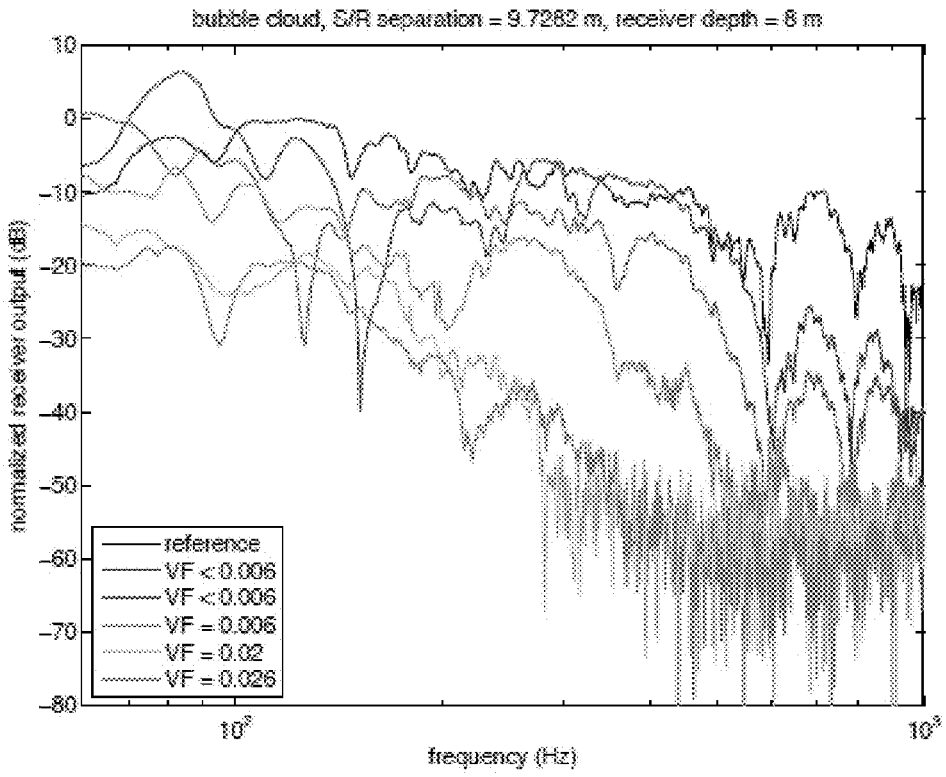
FIG. 26 depicts a comparison of attenuation measured at a range of 10 meters due to bubble clouds with varying void fractions.
Figure 27:
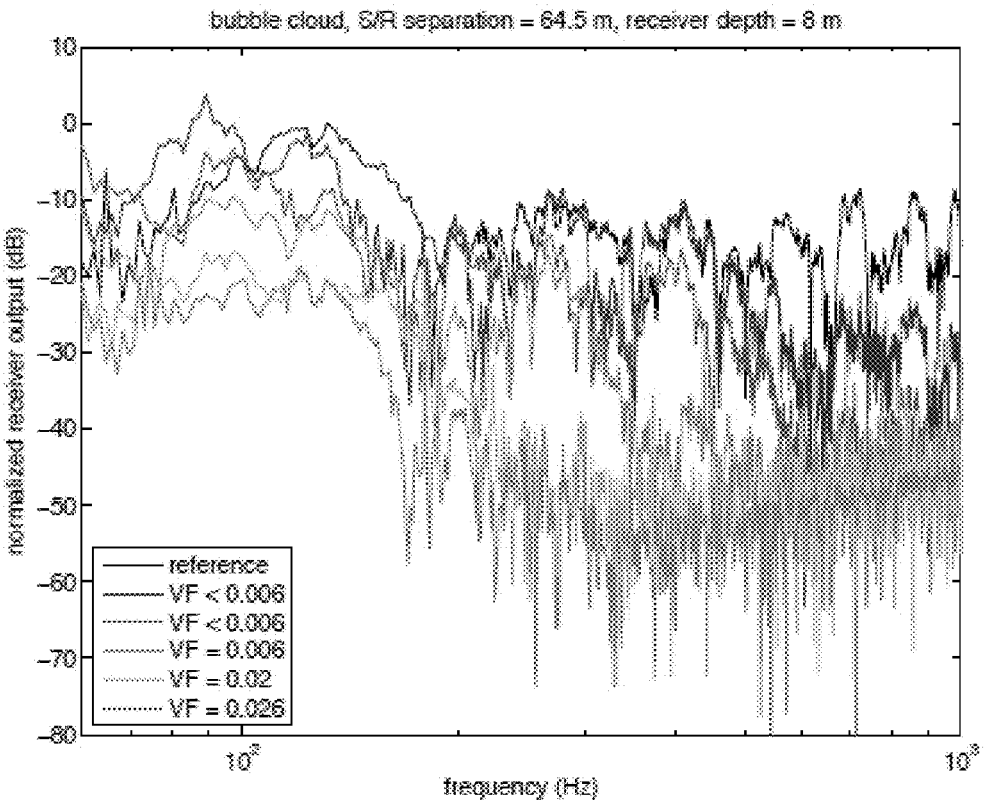
FIG. 27 depicts a comparison of attenuation measured at a range of 65 meters due to bubble clouds with varying void fractions.

To determine the effect of void fraction on the performance of the bubble cloud modality, the air flow rate to the diffuser hoses was varied. The corresponding air pressure on the hoses was measured with the submersible electronic pressure gauge and recorded so that the operating conditions could be reproduced in later tests. Higher measured pressure corresponds to a higher air flow rate, which is equivalent to higher void fraction within the bubble cloud. Comparisons of the received level for various void fractions are shown in FIGS. 26 and 27. Starting with the highest void fraction case at 0.026, the air flow rate was decreased to the lowest possible amount, which corresponded to a void fraction of less than 0.006. Decreasing the void fraction allows the high frequency components to exceed the ambient noise levels. For lower frequencies, the received level actually becomes greater than the bubble-free case. Although the physical mechanism which causes this effect is undetermined at this time, it is clear that the higher void fraction bubble clouds are be preferential to use in application and have the potential to obtain a significant amount of attenuation, even at low frequencies, due to impedance mismatching.

Figure 28:
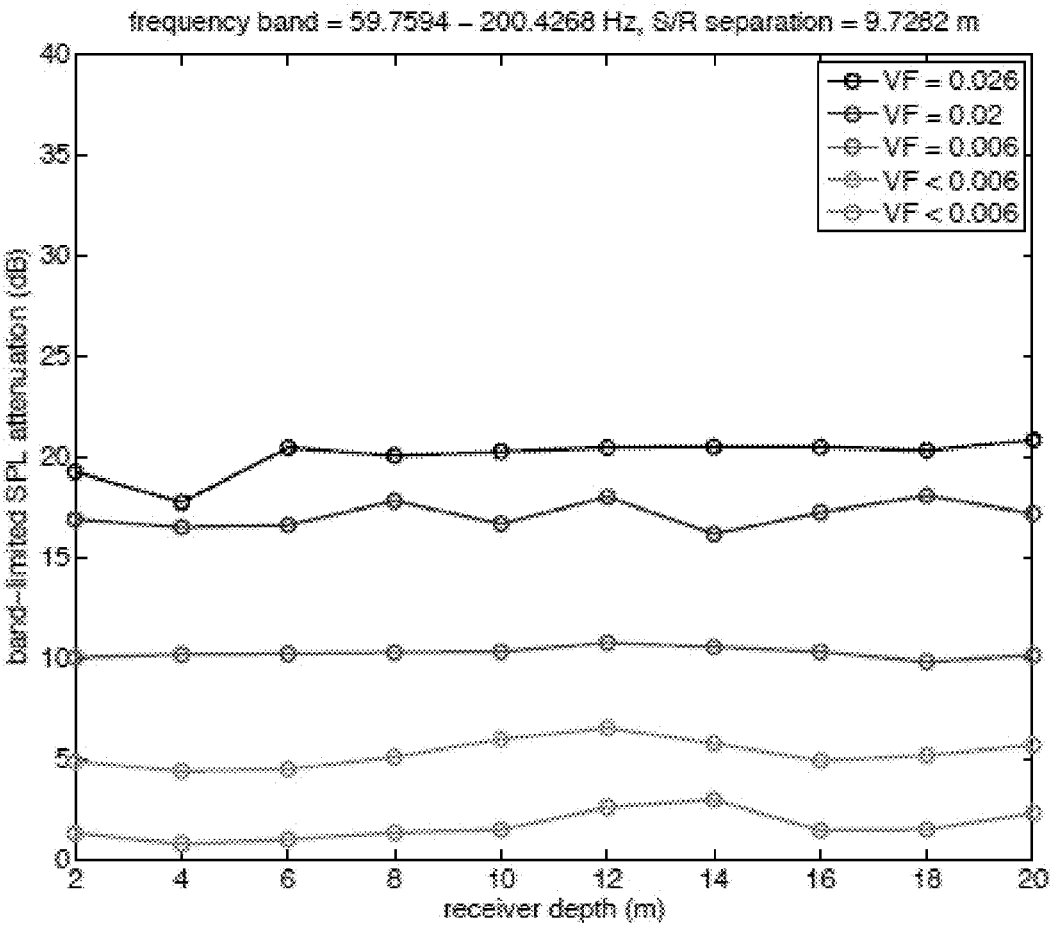
FIG. 28 depicts band-limited SPL reduction in the frequency range 60 Hz to 200 Hz due to the various bubble clouds.

The band-limited SPL reduction from 60 Hz to 200 Hz due to the bubble clouds was computed in the same manner as for the inner tube data. The results of these calculations are plotted for all five values of void fraction in FIG. 28. As observed with the inner tubes, the level of attenuation increases for higher void fraction and ranges from 1 dB re 1 μPa at the lowest void fraction to about 20 dB re 1 μPa at the highest void fraction.

Due to the disparity in individual bubble size between the inner tube and bubble cloud modalities, there are different frequency ranges over which the bubble resonance mechanism dominates the attenuation. Note that the acoustic impedance mismatch mechanism plays a role in attenuation over the entire range of frequencies for both modalities. The relative effectiveness of each modality over a given frequency band can be illuminated by looking at the transmission loss for each as a function of frequency and comparing them. Here, the transmission loss is defined as:

$$TL=|H|_{ref}-|H|_{bub}$$

where $|H|_{ref}$ is the measured transfer function for the bubble-free case and $|H|_{bub}$ is the measured transfer function for either the inner tube or bubble cloud case.

Figure 29:
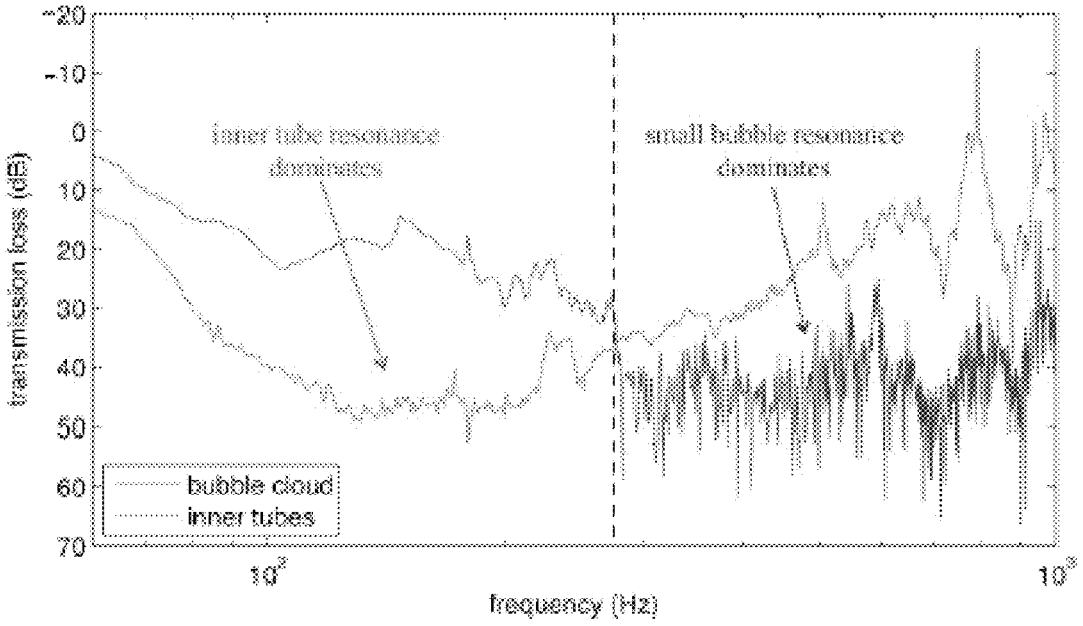
FIG. 29 depicts a transmission loss comparison between the gas-filled containers and bubble cloud modalities at a separation of about 10 m.
Figure 30:
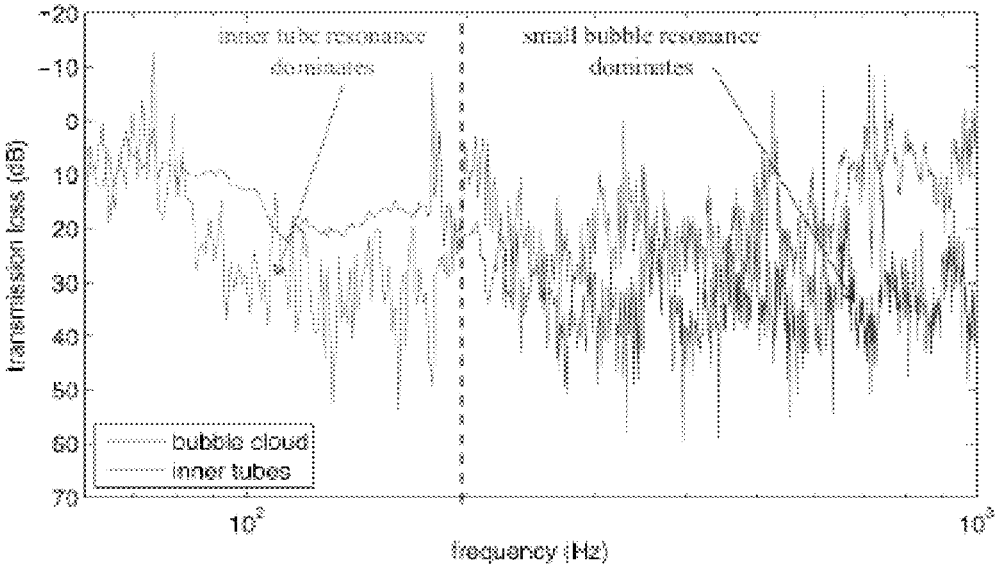
FIG. 30 depicts a transmission loss comparison between the gas-filled containers and bubble cloud modalities at a separation of about 65 m.

The transmission loss for both the bubble cloud and inner tube modalities are plotted in FIGS. 29 and 30. The inner tube configuration includes 150 large inner tubes with a void fraction of 0.02, and the bubble cloud case used an air flow rate of 17 cfm for an equivalent void fraction of 0.02. For frequencies below about 250 Hz, the inner tube resonance dominates, and this modality displays a greater reduction in radiated sound. Conversely, above this frequency range the small bubble resonance dominates, and the bubble cloud modality shows greater attenuation. This behavior is seen at both 10 meters and 65 meters although the data from the more distant receiver location displays a greater deal of ambient lake noise.

Figure 31:
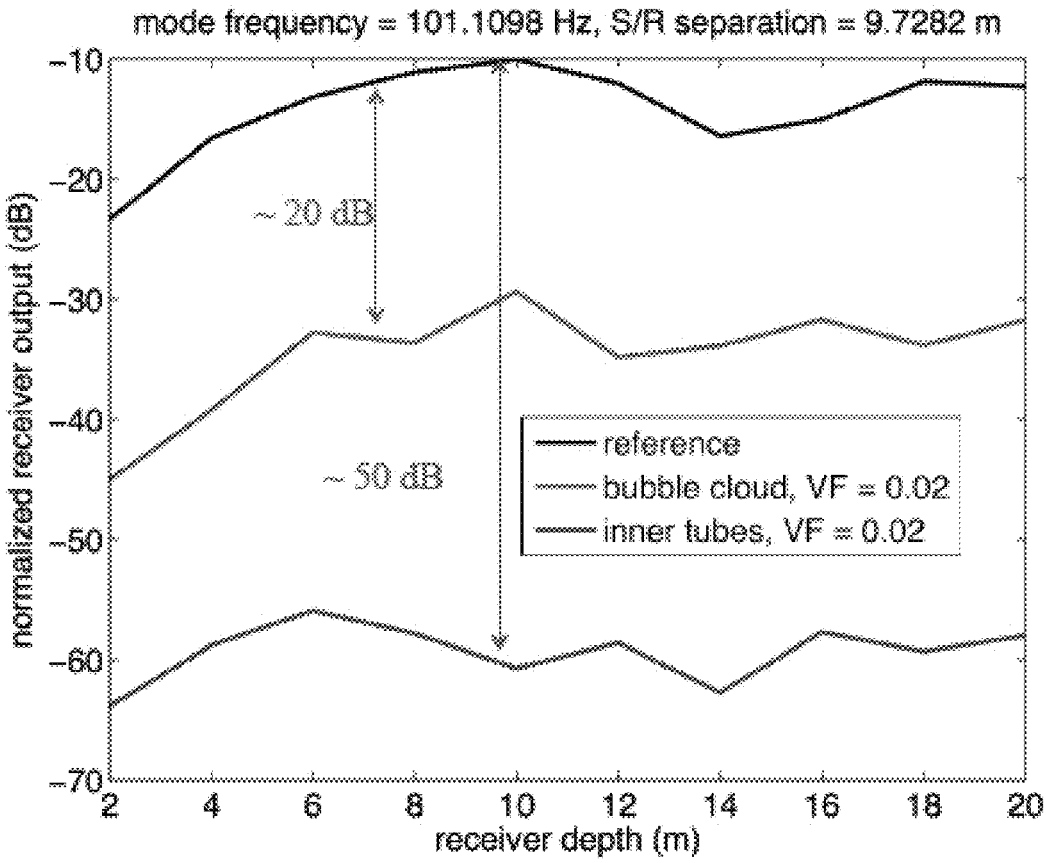
FIG. 31 depicts resonant longitudinal lake modes at 101.1 Hz.
Figure 32:
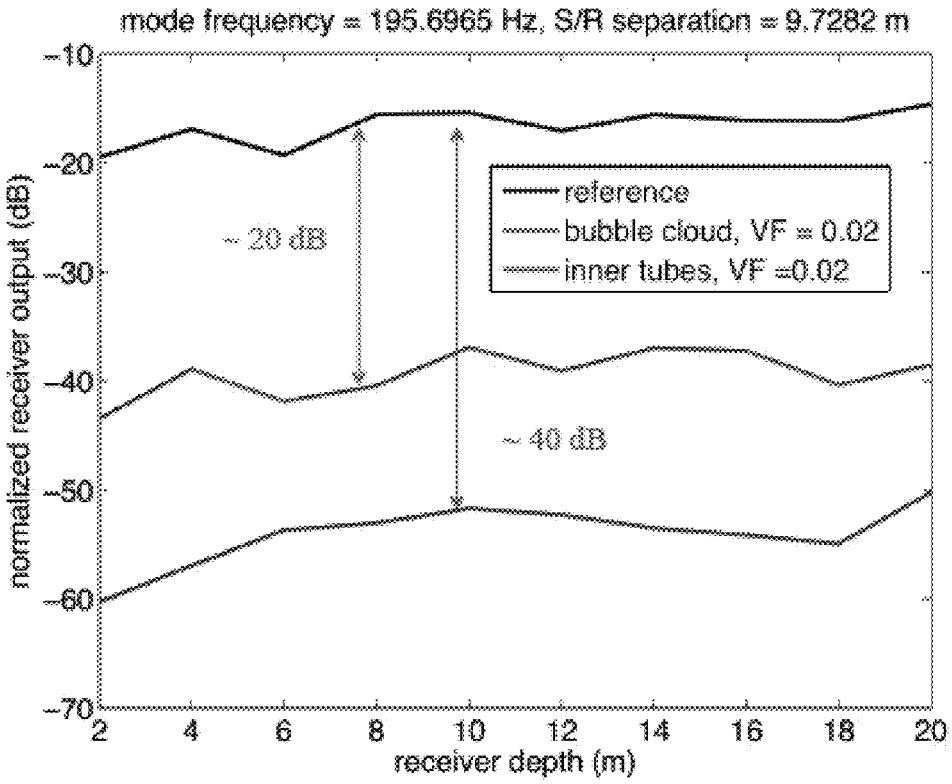
FIG. 32 depicts resonant longitudinal lake modes at 195.7 Hz.

For frequencies below the transition to bubble cloud dominance, the relative performance of each modality can be quantified by looking at some of the low-frequency lake resonances. FIGS. 31 and 32 show two spatial structure plots for the modes at 101.1 Hz and 195.7 Hz. For the mode at 101.1 Hz, the bubble cloud produces about 20 dB of reduction while the equivalent void fraction of inner tubes provides 50 dB of attenuation. Approximately 20 dB of attenuation is gained over the bubble cloud at 195.7 Hz using the inner tubes.

Figure 33A:
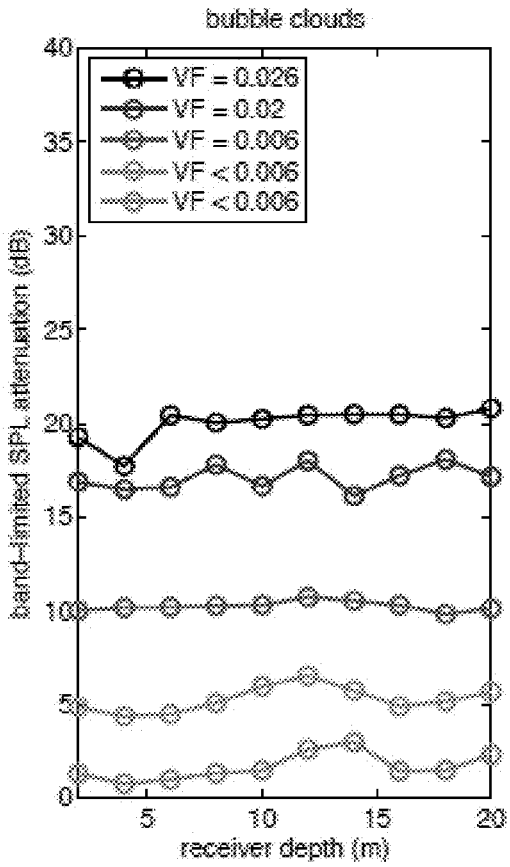
FIGS. 33A-B depict a comparison of band-limited SPL reduction for the bubble cloud and inner tube modalities.
Figure 33B:
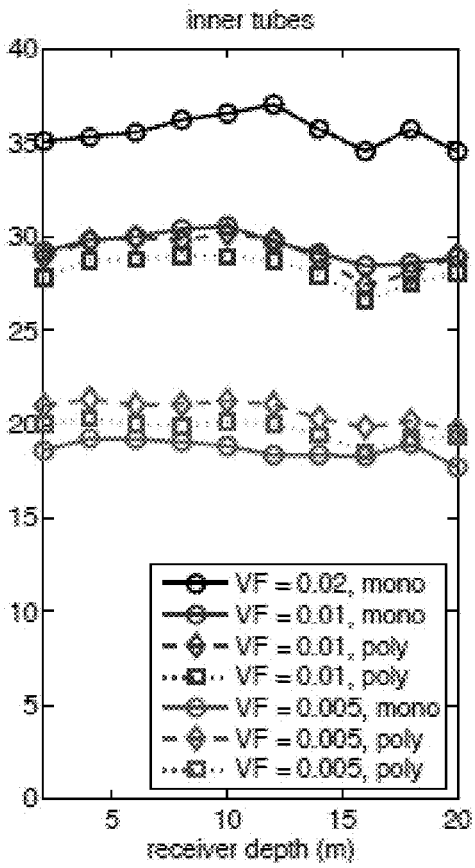

Comparison between bubble cloud and inner tube modalities of band-limited SPL reduction in the 60 Hz to 200 Hz further illustrates this difference. The band-limited SPL reduction is plotted for the five bubble cloud cases and a representative sample of inner tube cases in FIG. 33. For void fractions ranging from less than 0.06 to 0.026, the bubble cloud (FIG. 33A) produces ~1 dB to 20 dB of attenuation. The inner tube cases (FIG. 35B) range in void fraction from 0.005 to 0.02 and include both monodisperse and polydisperse distributions. The inner tube modality provides significantly more low-frequency attenuation for this comparable range of void fractions, ranging from 20 dB to 35 dB.

Although the inner tube modality consistently outperforms the bubble cloud at attenuating low frequencies, the bubble cloud modality could be used to augment attenuation from a few hundred hertz up to the kilohertz range, serving as motivation for testing a combination of the two modalities.

Selected inner tube configurations were combined with the bubble cloud modality to determine if the performance of the bubble screen system could be enhanced by using such a mixed modality. The 10 jumbo inner tube configuration was selected as the monodisperse inner tube distribution for the comparison because this configuration displays the highest attenuation below 100 Hz. Here, the void fraction is 0.005. Acoustic data was collected for this configuration with and without the presence of a roughly equivalent void fraction bubble cloud, which was generated using an air flow rate of 5 cfm.

Figure 34:
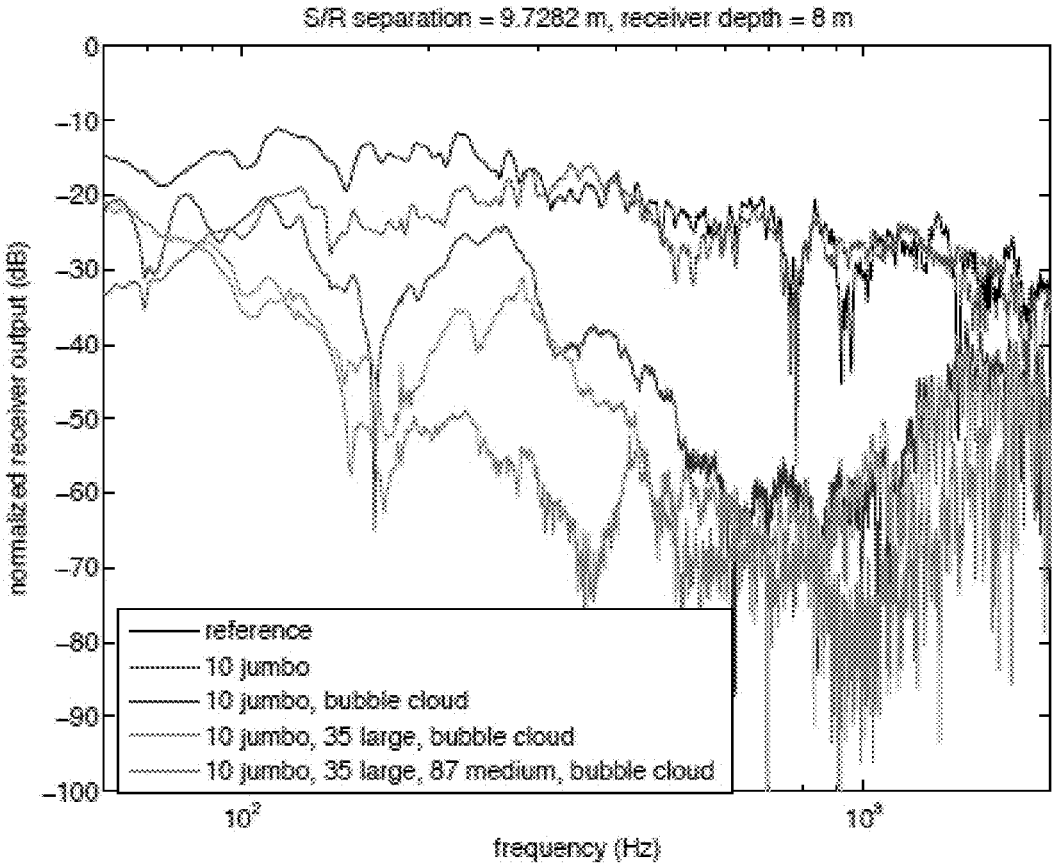
FIG. 34 depicts a comparison of the transfer functions between the 10 jumbo inner tube configuration and the various mixed modality cases at a range of about 10 m.
Figure 35:
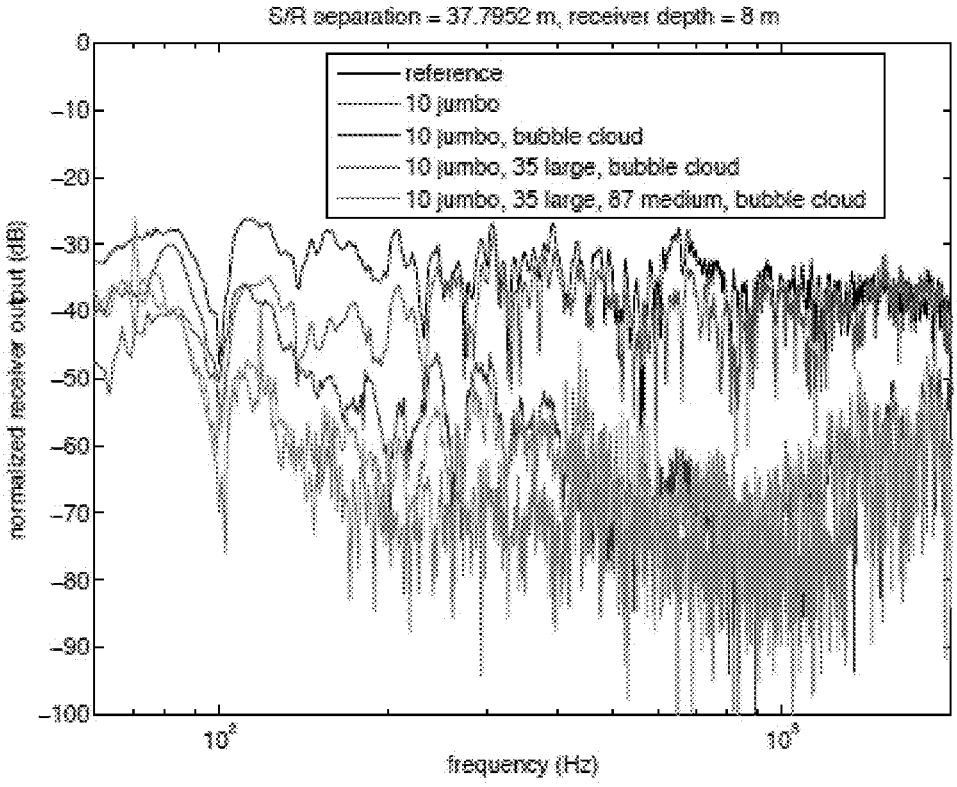
FIG. 35 depicts a comparison of the transfer functions between the 10 jumbo inner tube configuration and the various mixed modality cases at a range of about 38 m.

A comparison of the transfer functions for each of these cases is plotted in FIGS. 34 and 35 for receiver ranges of 10 meters and 38 meters, respectively. Note that use of the STEP barge was limited during this data collection so a location at the opposite end of the main barge was chosen for the more distant receiver. The 10 jumbo inner tube case shows a reduction of 17 to 18 dB at 60 Hz. When the bubble cloud is added, the attenuation is only about 6 or 7 dB at this frequency. The jumbo inner tube configuration outperforms the mixed case with the bubble cloud up until about 100 Hz after which the mixed case provides superior attenuation. The increase in the low-frequency amplitude when the bubble cloud is added is likely due the short-circuiting effect described in the earlier discussion on the polydisperse inner tube results.

Two other mixed-modality cases are plotted in FIGS. 34 and 35. One adds 35 large inner tubes to the jumbo inner tubes and bubble cloud; the other configuration adds 87 medium inner tubes to this case. In both of these data sets, the low-frequency attenuation is limited by the short-circuiting effect; however, the attenuation from a few hundred hertz to 1 kilohertz is notably improved. Similar behavior was observed at both receiver locations.

Figure 36:
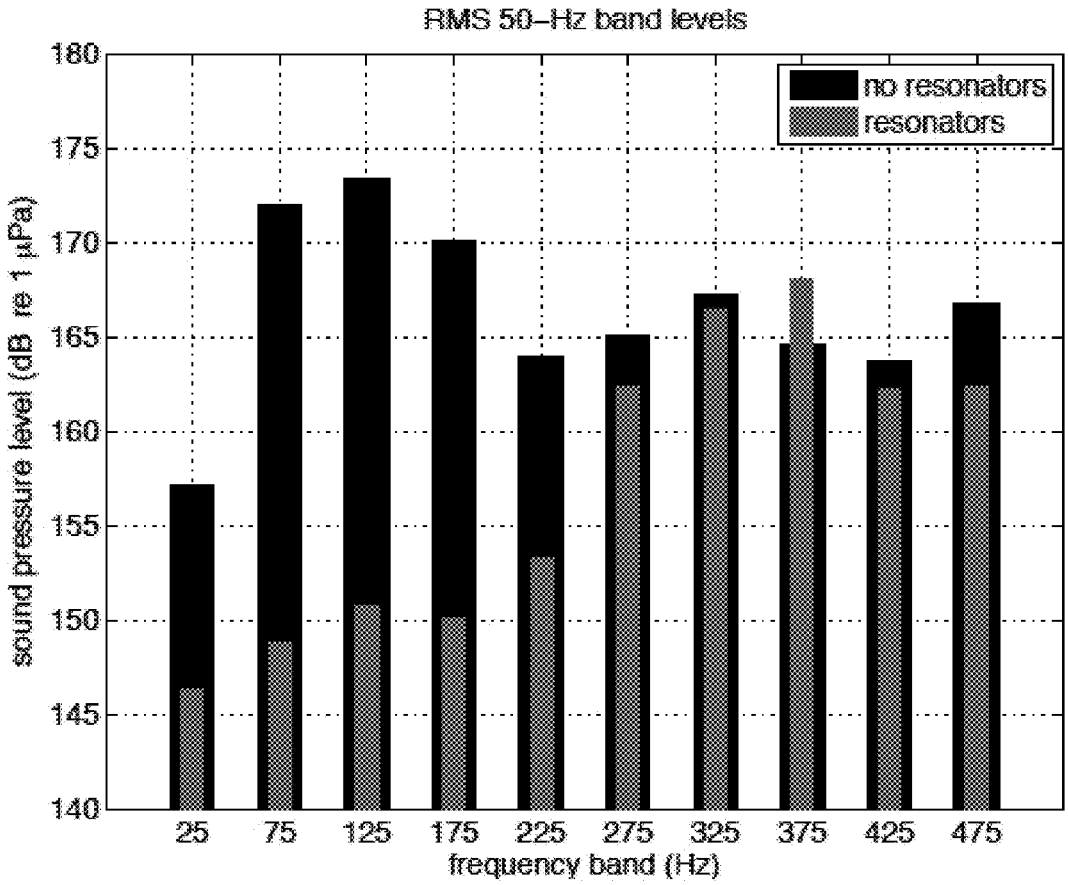
FIG. 36 depicts 50-Hz-band sound pressure level plot that shows the level reduction effects of the gas-filled containers on impulsive noise.

Testing has generally focused on constant sound sources. In some embodiments, the sound source producing the underwater noise is an impulsive noise generated by a sudden event (e.g., a pile driver). FIG. 36 depicts a 50-Hz-band sound pressure level plot that shows the level reduction effects of the resonators on impulsive noise generated by a combustive sound source (CSS). The sound source was first operated with no resonators present in the tank. The recorded sound pressure levels are shown by the black bars in the plot. The sound source was then surrounded by the noise reducing device, then was operated and recorded again. These levels are shown by the red bars in the plot. Gas-filled containers with an individual resonance frequency of approximately 100 Hz were chosen. The gas-filled containers were arranged in eight columns spanning most of the water column, with each line containing 20 gas-filled containers. The eight lines were arranged to surround the area in which the sound source was located, much like the way in which one would treat a pile driver with this system. FIG. 36 shows about 25 dB of sound pressure level reduction in the targeted frequency range with this resonator configuration.

Figure 37:
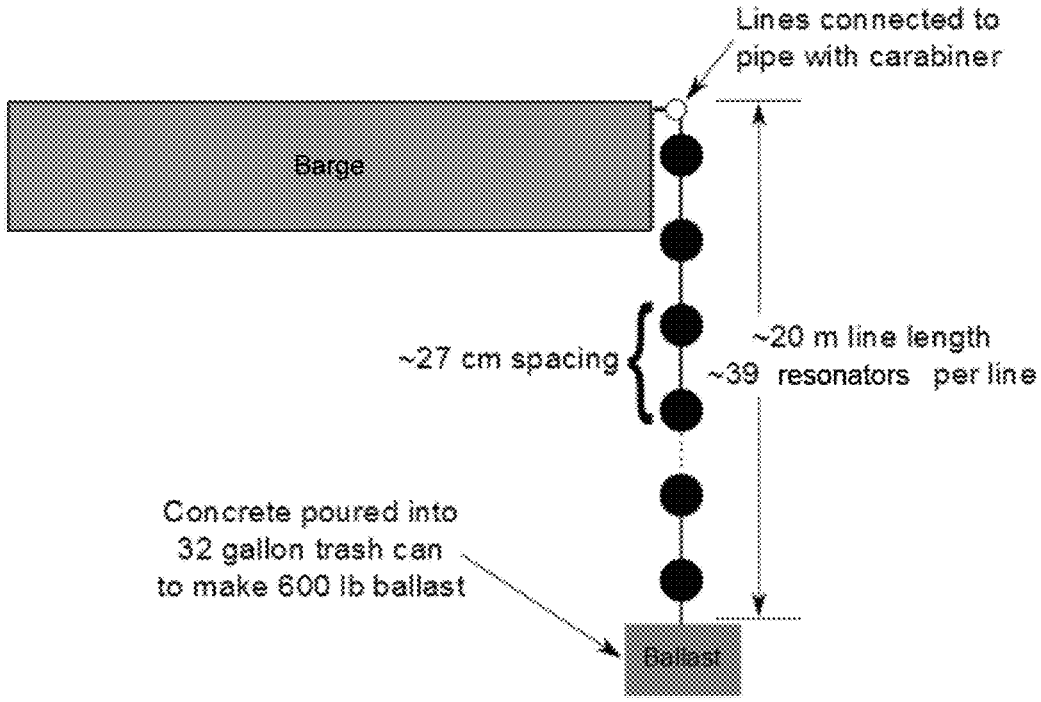
FIG. 37 depicts a schematic diagram of a line from a sound reducing device that includes a plurality of gas filled containers.
Figure 38:
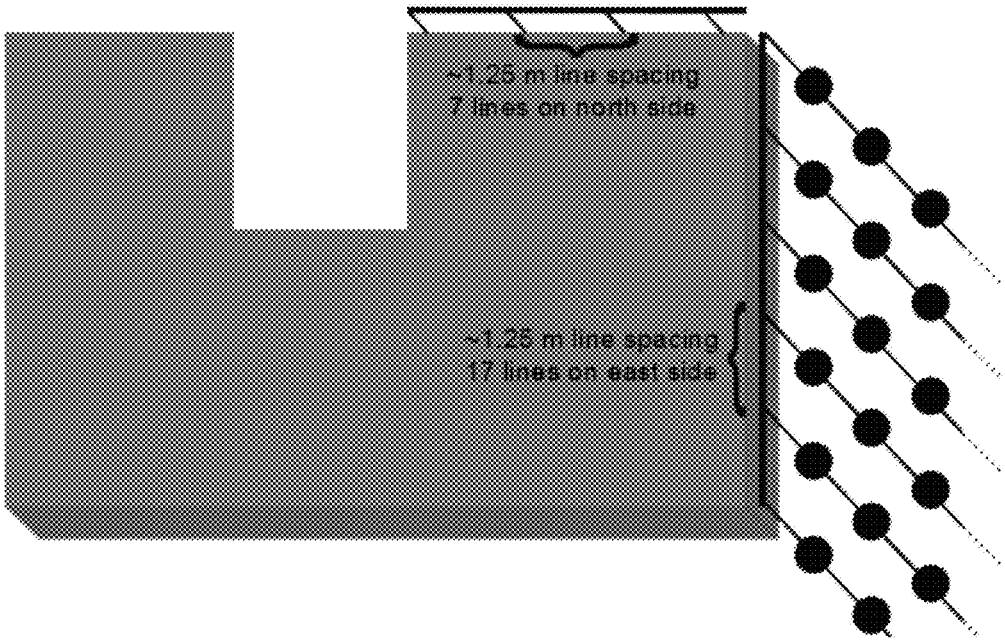
FIG. 38 depicts an overhead perspective diagram of a line of a sound reducing device that includes a plurality of gas filled containers.

In another embodiment, a noise reducing apparatus was prepared to reduce noise produced by a pile driving device. The noise reducing device includes 24 lines having gas-filled containers coupled to the lines. FIG. 37 depicts a schematic side view of a line. In one embodiment, a line may have a length of about 20 m, with gas-filled containers (resonators) spaced about 27 cm apart. Each line therefore has about 39 gas-filled containers. The lines were arranged around three hydrophone receivers that were attached to a platform a distance away from a pile driver. The lines are arranged on a support (or on a portion of a platform in the water) to create a curtain, as depicted in FIG. 38.

Figure 39:
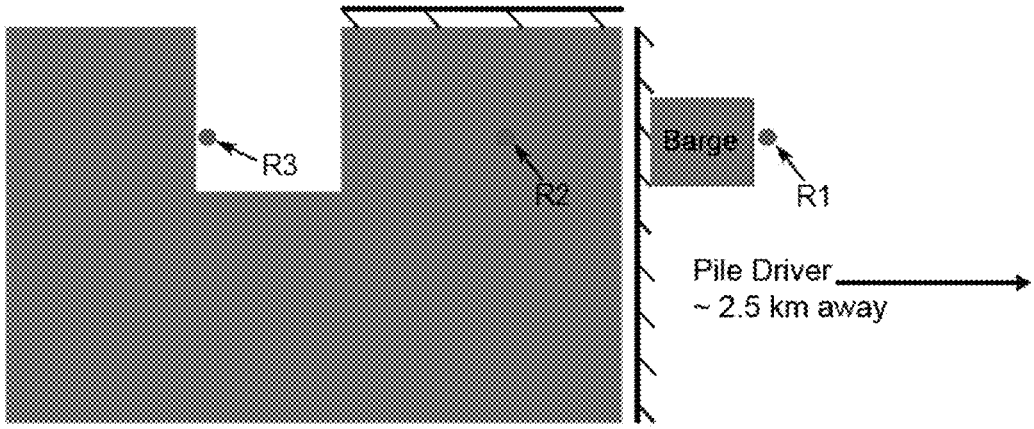
FIG. 39 depicts an overhead perspective diagram of a plurality of lines of a sound reducing device configured to provide a sound reducing curtain.

The lines were arranged to partially surround the receivers, as shown in FIG. 39. Receiver 1 ("R1") is positioned outside the sound reducing device, between the device and the pile driver. Receiver 2 ("R2") is positioned in an area partially surrounded by the sound reducing device such that the sound reducing device is between the receiver and the pile driver. Receiver 3 ("R3") is positioned at a point that is not surrounded by the sound reducing device, but with the sound reducing device disposed between the pile driver and the receiver.

The pile driver sound output was determined prior to testing. The pile driver has a measured peak-to-peak SPL of 210 dB @ 1 m; 185 dB @ 112 m; and 150 dB @ 2660 m. The sound produced by the pile driver varied from day to day by as much as ±10 db. Thus, the set up described above was used to obtain simultaneous measurements.

Figure 40:
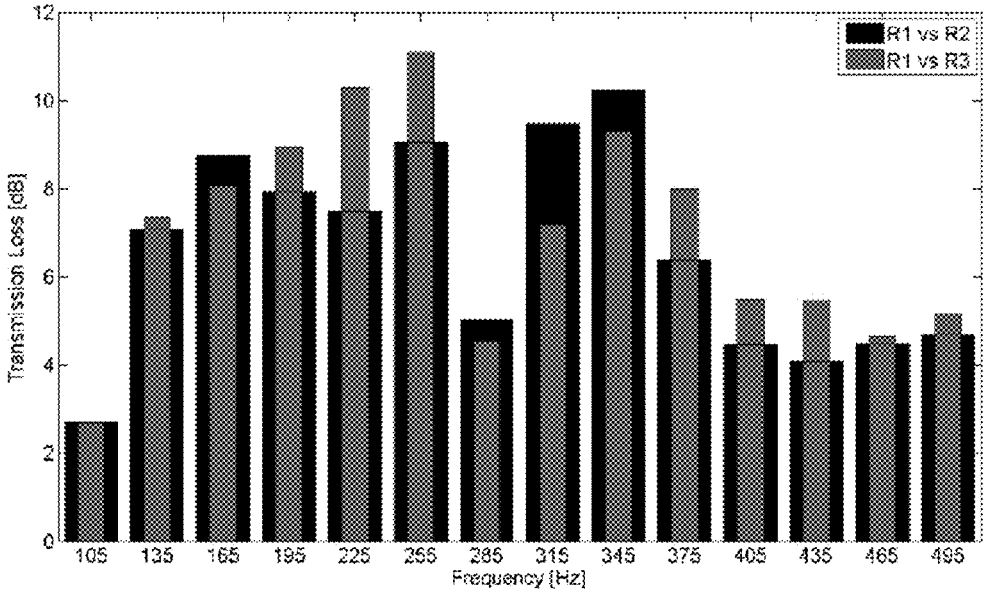
FIG. 40 depicts transmission loss results from an impulse sound source.

FIG. 40 depicts transmission loss results generated by comparing the difference in measured sound levels between R1 and R2 (black) and R1 and R3 (red). The comparisons are spatially averaged and the transmission loss is computed by comparing the same impulses. The results show significant transmission losses at both protected receivers.

Figure 41A:
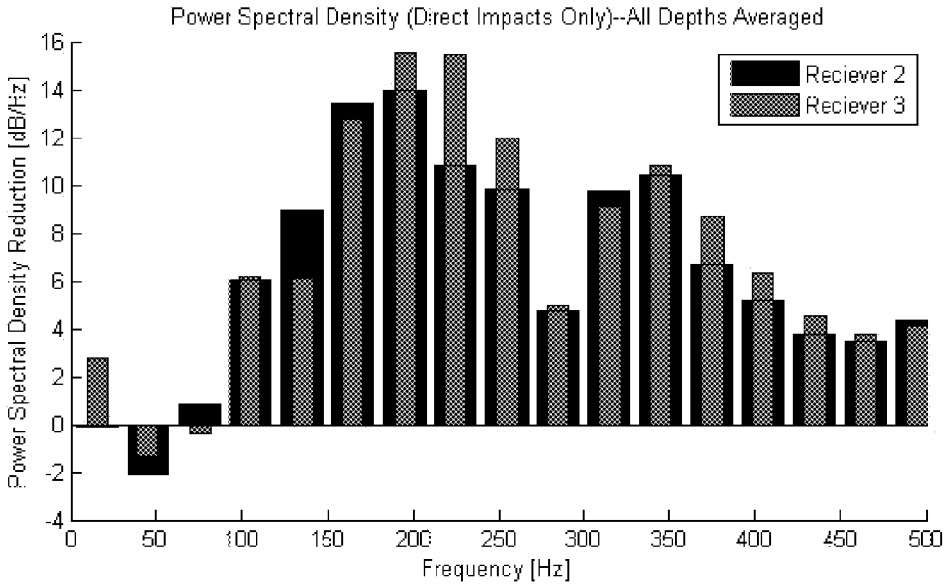
FIGS. 41A-B depicts power spectral density plots for direct and reflected sound impulses.
Figure 41B:
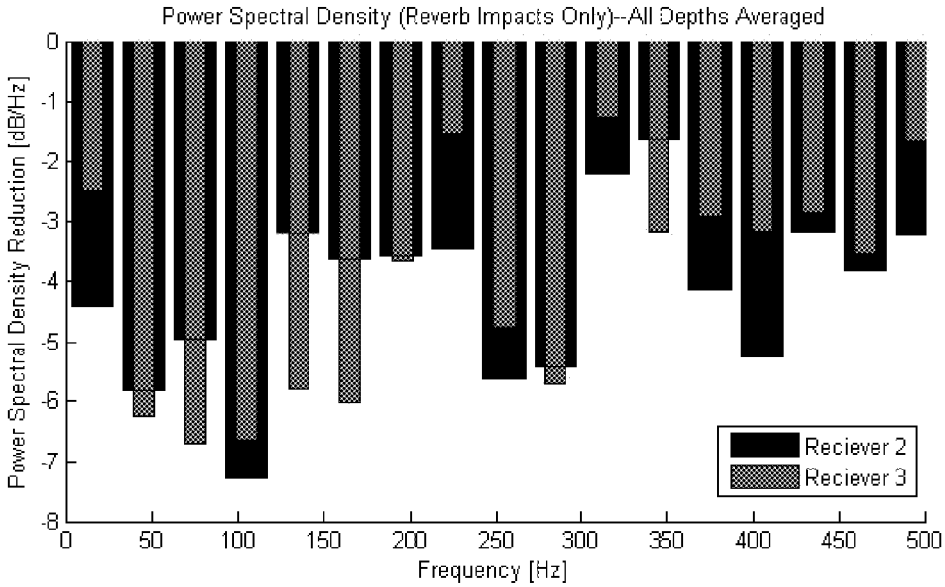

In the particular location used to test the device, a nearby dam produces a reflected sound wave that creates two distinct sound events during each cycle of the pile driver. The direct and reflected paths are predicted to travel through the sound reducing device in different directions. An algorithm was written to find and separate the two sound events. FIG. 41A depicts spectral density reduction for direct impacts only. FIG. 41B depicts spectral density reduction for reflected impacts only. The plots show that for direct path impulses, received level on the pile driver side of the curtain is higher than the dam side. For reflection path impulses, received level on the dam side of the curtain is higher than in front. Thus the sound reducing device works at attenuating both the direct signal from the pile driver and the reflected signal from the dam.

During the course of our tests, several inner tube and bubble cloud modalities were employed to determine the parametric dependence of the attenuation on the various bubble screen configurations. The primary conclusions from these experiments are:

1. Surrounding the sound source with inner tubes was demonstrated to provide levels of attenuation at low frequencies of 40 dB or more due to a combination of bubble resonance and acoustic impedance mismatching mechanisms. The amount of attenuation was shown to depend primarily on the total void fraction.
2. The addition of multiple discrete inner tube sizes seems to have only a second-order effect on the radiated levels in comparison to the effect of global void fraction.
3. Using larger volumes of encapsulated air, the bubble resonance mechanism can be used to reduce the radiated level of lower frequencies. The results suggested that the simplest and possibly most effective solution would be to use a high void fraction of very large inner tubes to provide the best low-frequency attenuation.
4. Surrounding the sound source with a cloud of small freely-rising bubbles was shown to provide attenuation, the amount of which was also highly dependent on the void fraction. For frequencies below the bubble resonance, attenuation of as much as 20 dB was observed due to impedance mismatch effects for high void fraction bubble clouds. For frequencies extending from a few hundred hertz up to one kilohertz, an increase in absorption was observed, which was aided by bubble resonance absorption. It is possible that for some applications, the use of a high void fraction bubble cloud would provide the required reduction in radiated sound.
5. Tests with both inner tubes and bubble clouds suggest that combining the modalities has the potential to provide increased attenuation across a broader range of frequencies, although some subtle effects must be considered. Due to their disparity in size, the constituent bubble sub-populations can have opposing interactions with the radiated sound, possibly leading to less attenuation in certain frequency bands. Thus, care should be taken when determining the void fractions of the various sub-populations in the mixed modality case to minimize these effects.
6. Broadband transfer function measurements are useful for a complete understanding of the sound field, but the current regulations rely on sound pressure level measurements which are a time-domain average measurements. An approximation of the average sound pressure level in the 60 Hz to 200 Hz frequency band was computed from transfer function measurements. Inner tubes were shown to provide up to 35 dB of attenuation in this frequency band while bubble clouds provided up to 20 dB of attenuation for comparable void fractions.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as examples of embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

What is claimed is:

1. An apparatus that reduces the decibel level of underwater sounds emanating from an underwater device comprising:

a support positionable proximate to the underwater device, wherein the support comprises a plurality of rigid support members; and a plurality of gas-filled containers coupled to the support, wherein each of the plurality of gas-filled containers comprises a flexible membrane filled with a gas, and wherein the plurality of gas-filled containers are connected to the plurality of rigid support members such that at least some of the plurality of gas-filled containers are in contact with one or more of the plurality of rigid support members, and wherein when deployed proximate to the underwater device, the rigid support members prevent vertical and horizontal movement of the plurality of gas-filled containers;

wherein each of the gas-filled containers has a physical characteristic that confers a selected resonance frequency to each of the plurality of gas-filled containers upon immersion into the water surrounding the underwater device;

and wherein the total volume of air contained in the gas-filled containers and/or and the number of gas-filled containers creates a void fraction for the device such that a preselected noise reduction is achieved.

2. The apparatus of claim 1, wherein the plurality of gas-filled containers comprises two or more sets of gas-filled containers, each set of gas-filled container having a shape that is different from one or more other sets of gas-filled containers.

3. The apparatus of claim 1, wherein the support is configurable to at least partially surround the underwater device.

4. The apparatus of claim 1, wherein the gas-filled containers have a configuration that reduces the decibel level of one or more frequencies between about 10 Hz and 1000 Hz emanating from the underwater device.

5. The apparatus of claim 1, wherein the gas-filled containers has a non-spherical or substantially non-spherical wall.

6. The apparatus of claim 1, wherein the gas-filled containers have a toroidal shape, wherein the central portion of the toroidal gas-filled containers is open such that, during use, water passes through the center of the toroidal gas-filled containers.

7. The apparatus of claim 1, wherein the flexible membrane has a wall thickness of between about 0.5 mm and about 5 mm.

8. The apparatus of claim 1, wherein the flexible membrane is composed of rubber.

9. The apparatus of claim 1, further comprising a bubble generator positioned proximate to the support, wherein, when the support is positioned proximate to the underwater device, the bubble generator produces a curtain of bubbles capable of reducing the decibel level of underwater sounds emanating from the underwater device.

10. The apparatus of claim 1, wherein the plurality of gas-filled containers comprises two or more sets of gas-filled containers, each set of gas-filled container having a size that is different from one or more other sets of gas-filled containers.

11. The apparatus of claim 10, wherein each set of gas-filled containers is configured for noise reduction at different frequencies.

12. A method comprising:

positioning an apparatus that reduces the decibel level of underwater sounds emanating from an underwater device proximate to the underwater device, the apparatus comprising:

a support positionable proximate to the underwater device, wherein the support comprises a plurality of rigid support members; and a plurality of gas-filled containers coupled to the support, wherein each of the plurality of gas-filled containers comprises a flexible membrane filled with a gas, and wherein the plurality of gas-filled containers are connected to the plurality of rigid support members such that at least some of the plurality of gas-filled containers are in contact with one or more of the plurality of rigid support members, and wherein when deployed proximate to the underwater device, the rigid support members prevent vertical and horizontal movement of the plurality of gas-filled containers;

wherein each of the gas-filled containers has a physical characteristic that confers a selected resonance frequency to each of the plurality of gas-filled containers upon immersion into the water surrounding the underwater device;

and wherein the total volume of air contained in the gas-filled containers and/or and the number of gas-filled containers creates a void fraction for the device such that a preselected noise reduction is achieved, operating the underwater device, wherein the apparatus reduces the decibel level of underwater sounds emanating from the device.

13. A method comprising: positioning an apparatus that reduces the decibel level of underwater sounds in a region, underwater, that is in need of protection from sounds emanating from an underwater device, the apparatus comprising:

a support positionable proximate to the underwater device, wherein the support comprises a plurality of rigid support members; and a plurality of gas-filled containers coupled to the support, wherein each of the plurality of gas-filled containers comprises a flexible membrane filled with a gas, and wherein the plurality of gas-filled containers are connected to the plurality of rigid support members such that at least some of the plurality of gas-filled containers are in contact with one or more of the plurality of rigid support members, and wherein when deployed proximate to the underwater device, the rigid support members prevent vertical and horizontal movement of the plurality of gas-filled containers;

wherein each of the gas-filled containers has a physical characteristic that confers a selected resonance frequency to each of the plurality of gas-filled containers upon immersion into the water surrounding the underwater device;

and wherein the total volume of air contained in the gas-filled containers and the number of gas-filled containers creates a void fraction for the device such that a preselected noise reduction is achieved, wherein the apparatus reduces the decibel level of underwater sounds emanating from the underwater sounds emanating from the underwater device in the region that is shielded by the apparatus.

14. An apparatus that reduces the decibel level of underwater sounds emanating from an underwater device comprising:

a support; and a plurality of gas-filled containers coupled to the support, wherein each of the plurality of gas-filled containers comprises a flexible membrane filled with a gas and wherein one or more of the plurality of gas-filled containers have a toroidal shape, and wherein the central portion of the toroidal gas-filled containers is open such that, during use, water passes through the center of the toroidal gas-filled containers, and wherein each of the gas-filled containers has a physical characteristic that confers a selected resonance frequency to each of the plurality of gas-filled containers upon immersion into the water surrounding the underwater device;

and wherein the total volume of air contained in the gas-filled containers and the number of gas-filled containers creates a void fraction for the device such that a preselected noise reduction is achieved.

* * * * *